US009198268B2

(12) United States Patent
Kuma

(10) Patent No.: US 9,198,268 B2
(45) Date of Patent: Nov. 24, 2015

(54) STATIC ELIMINATOR AND IMAGE FORMING APPARATUS INCLUDING SAME

(71) Applicant: Kazuosa Kuma, Kanagawa (JP)

(72) Inventor: Kazuosa Kuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/506,036

(22) Filed: Oct. 3, 2014

(65) Prior Publication Data

US 2015/0110528 A1 Apr. 23, 2015

(30) Foreign Application Priority Data

Oct. 22, 2013 (JP) ..... 2013-218908
Aug. 22, 2014 (JP) ..... 2014-169089

(51) Int. Cl.

| | |
|---|---|
| ***G03G 15/02*** | (2006.01) |
| ***H05F 3/00*** | (2006.01) |
| ***G03G 15/00*** | (2006.01) |
| *G03G 15/23* | (2006.01) |

(52) U.S. Cl.
CPC ..... *H05F 3/00* (2013.01); *G03G 15/657* (2013.01); *G03G 15/235* (2013.01)

(58) Field of Classification Search
CPC ..... G03G 2215/00649; G03G 15/657; G03G 2215/00654; G03G 15/0291; G03G 15/6535
See application file for complete search history.

(56) References Cited

U.S. PATENT DOCUMENTS

| | | | | |
|---|---|---|---|---|
| 3,792,312 | A * | 2/1974 | Marx | 361/230 |
| 5,307,234 | A * | 4/1994 | Homolka | 361/229 |
| 5,367,366 | A * | 11/1994 | Kido et al. | 399/315 |
| 2006/0210307 | A1 | 9/2006 | Katoh et al. | |
| 2006/0210324 | A1 | 9/2006 | Kuma et al. | |
| 2006/0284958 | A1 | 12/2006 | Saeki et al. | |
| 2007/0098472 | A1 | 5/2007 | Saeki et al. | |
| 2011/0103862 | A1 | 5/2011 | Saeki et al. | |
| 2013/0177341 | A1 | 7/2013 | Saeki et al. | |

FOREIGN PATENT DOCUMENTS

| | | |
|---|---|---|
| JP | 8-059029 | 3/1996 |
| JP | 2004-004336 | 1/2004 |
| JP | 2006-030540 | 2/2006 |
| JP | 2009-075513 | 4/2009 |
| JP | 2010-256790 | 11/2010 |

* cited by examiner

*Primary Examiner* — G. M. Hyder
(74) *Attorney, Agent, or Firm* — Oblon, McClelland, Maier & Neustadt, L.L.P.

(57) ABSTRACT

A static eliminator includes a plurality of static eliminating needles, a holder including a retaining surface on which the plurality of static eliminating needles is held, a plurality of partitions, and a restriction member including a first end portion having a restriction surface at a static eliminating needle side to contact the static eliminating needles. A length of the plurality of static eliminating needles from the first end portion of the restriction member as an origin to a leading end of the plurality of static eliminating needles is shorter than a distance from the origin to an end surface of the plurality of partitions within the range of movement of the plurality of static eliminating needles from the retaining surface up to a position five degrees (5°) below the restriction surface in an angle between the retaining surface and an imaginary plane including the restriction surface.

15 Claims, 15 Drawing Sheets

STATIC ELIMINATOR AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application Nos. 2013-218908, filed on Oct. 22, 2013, and 2014-169089, filed on Aug. 22, 2014, both in the Japan Patent Office, which are hereby incorporated herein by reference in their entirety.

BACKGROUND

1. Technical Field

Exemplary aspects of the present invention generally relate to a static eliminator that eliminates static electricity on a recording medium passing through a transfer region at which a toner image formed on an image bearing member is transferred onto a recording medium, and an image forming apparatus including the static eliminator.

2. Description of the Related Art

There are two types of known image forming apparatuses: one that directly transfers a toner image formed on a latent image bearing member onto a recording medium and another that transfers a toner image primarily onto an intermediate transfer device and then onto a recording medium.

In such image forming apparatuses, when the recording medium passes through a transfer nip at which an image bearing member such as the latent image bearing member and the intermediate transfer device meets and contacts a transfer device, the transfer device forms a transfer electrical field between the recording medium and the image bearing member.

Generally, a relatively large transfer bias having a polarity opposite that of a charge polarity of toner is applied to the rear surface of the recording medium to transfer the toner image from the image bearing member onto the front surface of the recording medium. Because the transfer bias applied to the rear surface of the recording medium is relatively large, the rear surface of the recording medium having passed through the transfer nip has charges having the same polarity as that of the transfer bias, that is, the opposite polarity to the charge polarity of the toner. The charges on the rear surface of the recording medium hold the toner image onto the front surface.

However, if the charges on the rear surface of the recording medium immediately after passing through the transfer nip are excessive, sudden leakage of charges on the rear surface occurs relative to protruding members and metals disposed near a sheet transport path downstream from the transfer nip but upstream from a fixing section in a transport direction of the recording medium. In this case, the toner image on the front surface of the recording medium is disturbed, hence causing image failure.

In view of the above, static eliminators have been proposed to remove static charges from the recording medium. For example, a known static eliminator includes a static eliminating plate to remove static charges from the recording medium near the end of the transfer nip. The static eliminating plate is a conductive thin planar member made of stainless steel or the like. A plurality of static eliminating needles is formed spaced apart a certain distance between each other and parallel to a width direction of the recording medium.

The static charges on the recording medium are removed by the static eliminator near the end of the transfer nip to prevent image failure attributed to conveyance of the charged recording medium bearing an unfixed toner image.

Although advantageous, when clearing paper jams or during maintenance by technicians, clothes of the technicians may get caught by the sharp tips of static eliminating needles, resulting in breakage of the static eliminating needles.

In view of the above, there is demand for a static eliminator in which the tip of static eliminating needles is prevented from getting damaged and an image forming apparatus including the static eliminator.

SUMMARY

In view of the foregoing, in an aspect of this disclosure, there is provided an improved a static eliminator including a plurality of static eliminating needles, a holder, a plurality of partitions, and a restriction member. The plurality of static eliminating needles is arranged in a width direction of a recording medium and includes a free end at one end of the plurality of static eliminating needles facing a surface of the recording medium. The holder includes a retaining surface on which the plurality of static eliminating needles is held. The plurality of partitions is arranged in a standing manner between the plurality of static eliminating needles on the retaining surface of the holder. The restriction member is disposed facing the retaining surface of the holder via the plurality of static eliminating needles and includes a first end portion having a restriction surface at a static eliminating needle side to contact the plurality of static eliminating needles to regulate a range of movement of a leading end of the plurality of static eliminating needles. A length of the plurality of static eliminating needles from the first end portion as an origin to the leading end of the plurality of static eliminating needles is shorter than a distance from the origin to an end surface of the plurality of partitions within the range of movement of the plurality of static eliminating needles from the retaining surface up to a position five degrees (5°) below the restriction surface in an angle between the retaining surface and an imaginary plane including the restriction surface.

In another aspect of this disclosure, an image forming apparatus includes an image bearing member, a transfer device, and the static eliminator. The image bearing member bears a toner image on a surface thereof. The transfer device transfers the toner image from the image bearing member onto a recording medium at a transfer region. The static eliminator eliminates static charges from the recording medium that has passed through the transfer region.

In still another aspect of this disclosure, an image forming apparatus includes a static eliminating needle, a first holder, and a pair of ribs. The static eliminating needle includes a leading end that faces a transport path along which a recording medium is transported. The first holder holds the static eliminating needle such that the leading end of the static eliminating needle projects beyond the first holder for a predetermined distance. The pair of ribs is disposed near the static eliminating needle such that the leading end of the static eliminating needle does not project beyond the pair of ribs within a range from a position at which the leading end of the static eliminating needle faces the transport path to a position of the leading end of the static eliminating needle bent vertically from the first holder as an origin.

In still another aspect of this disclosure, an image forming apparatus includes a static eliminating needle, a pair of ribs, and a projection. The static eliminating needle includes a leading end facing a transport path along which a recording medium is transported. The pair of ribs is disposed near the leading end of the static eliminating needle. The projection is disposed between the pair of ribs. The leading end of the static eliminating needle projects beyond the projection for a predetermined distance toward the transport path, and the pair of ribs is disposed such that the leading end of the static eliminating needle does not project beyond the pair of ribs within a range from a position at which the leading end of the static eliminating needle faces the transport path to a position of the leading end of the static eliminating needle bent vertically from the pair of ribs as an origin.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1A:
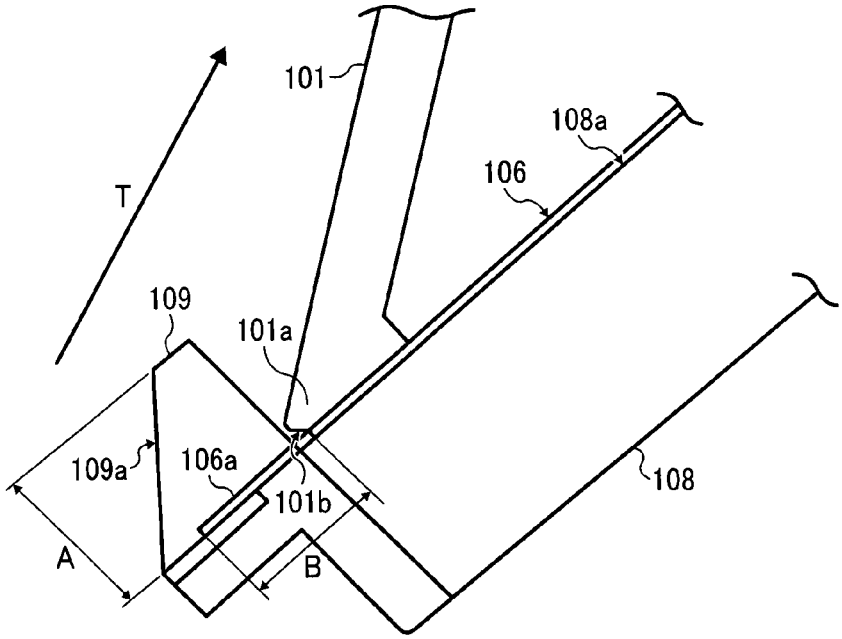
FIG. 1A is a cross-sectional view schematically illustrating a static eliminating portion in a state in which a tip of a static eliminating needle at the static eliminating portion is at a default position according to a first illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

Figure 2:
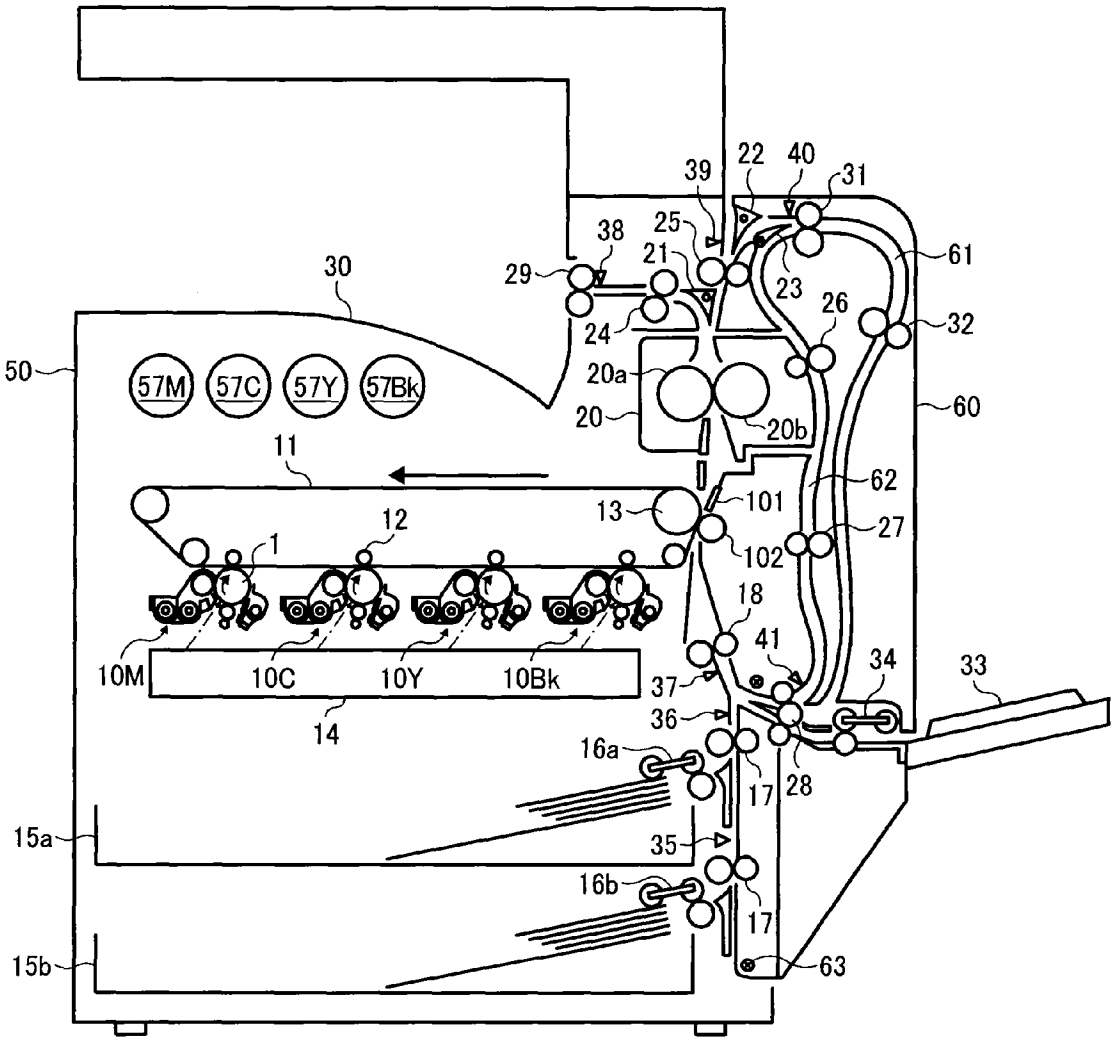
FIG. 2 is a schematic diagram illustrating a copier as an example of an image forming apparatus according to an illustrative embodiment of the present disclosure.

FIG. 2 is a schematic diagram illustrating a copier as an example of an image forming apparatus according to an illustrative embodiment of the present disclosure;

The image forming apparatus includes a main body 50 in which an intermediate transfer belt 11 serving as an image bearing member is disposed substantially at the center of the main body 50. The intermediate transfer belt 11 is entrained around and stretched taut between a plurality of rollers. The intermediate transfer belt 11 is formed into an endless loop. Specific preferred material suitable for the intermediate transfer belt 11 includes, but is not limited to, polyimide as a main component.

In the main body 50, four image forming units 10M, 10C, 10Y, and 10Bk are disposed outside the looped intermediate transfer belt 11 along the belt surface. More specifically, the image forming units 10M, 10C, 10Y, and 10Bk are arranged along the belt surface facing down in the vertical direction. Each of the image forming units 10M, 10C, 10Y, and 10Bk includes a photosensitive drum 1 as a latent image bearing member. The photosensitive drum 1 is surrounded by various pieces of imaging equipment, such as a charging device, a development device, a cleaning device, and so forth.

Primary transfer rollers 12 serving as primary transfer devices are disposed inside the looped intermediate transfer belt 11, opposite the respective photosensitive drums 1.

In the present illustrative embodiment, four image forming units 10M, 10C, 10Y, and 10Bk all have the same configuration, differing only in the color of toner employed in the development devices. It is to be noted that reference characters M, C, Y, and Bk denote the colors magenta, cyan, yellow, and black, respectively. To simplify the description, the reference characters M, C, Y, and Bk indicating colors are omitted herein unless otherwise specified.

In the present illustrative embodiment, four image forming units 10M, 10C, 10Y, and 10Bk are arranged in the order of magenta, cyan, yellow, and black from the left in FIG. 2. However, the order is not limited thereto. Each of the image forming units 10M, 10C, 10Y, and 10Bk is detachably mountable as a process cartridge relative to the main body 50.

An optical writing unit 14 for writing a latent image on the photosensitive drums 1 is disposed substantially below the image forming units 10M, 10C, 10Y, and 10Bk. The optical writing unit 14 includes mirrors including a polygon mirror to direct modulated laser light onto the surface of photosensitive drums 1.

The optical writing unit 14 may be provided to each of the image forming units 10M, 10C, 10Y, and 10Bk. However, in terms of cost saving, using a common optical writing unit is advantageous.

It is to be noted that in the present illustrative embodiment the intermediate transfer belt 11 and the optical writing unit 14 are also unitized, allowing the intermediate transfer belt 11 and the optical writing unit 14 to be detachably mountable relative to the main body 50.

Toner bottles 57M, 57C, 57Y, and 57BK filled with toners of yellow, cyan, magenta, and black are disposed at the upper portion of the main body 50. A certain amount of toner is supplied from the toner bottles 57M, 57C, 57Y, and 57BK to the respective development devices as needed via a transport path.

In the main body 50, sheet cassettes 15*a* and 15*b* are disposed substantially at the bottom of the main body 50. The sheet cassettes 15*a* and 15*b* include sheet feed devices 16*a* and 16*b*, respectively. Each of the sheet feed devices 16*a* and 16*b* is equipped with a pickup roller, a feed roller, and a separation roller. A pair of conveyor rollers 17 (17*a* and 17*b* in FIG. 3) delivers a recording medium such as transfer paper fed by the sheet feed devices 16*a* and 16*b*.

A pair of registration rollers 18 is disposed substantially above the pair of conveyor rollers 17 in FIG. 2 (downstream from the conveyor rollers 17 in a transport direction of the recording medium).

A secondary transfer roller assembly 100 (shown in FIG. 4) is disposed substantially above the pair of registration rollers 18. As will be described later in detail, the secondary transfer roller assembly 100 includes a secondary transfer roller 102 serving as a secondary transfer device and a guide plate 101 serving as a restriction member. The secondary transfer roller 102 is disposed opposite to a secondary-transfer opposed roller 13 which is one of the plurality of rollers about which the intermediate transfer belt 11 is entrained.

The guide plate 101 is disposed downstream from a secondary transfer section (transfer region) in the transport direction of the recording medium. The guide plate 101 contacts the recording medium during conveyance to control the transport direction of the recording medium. A fixing device 20 is disposed downstream from the guide plate 101 in the transport direction of the recording medium. The fixing device 20 includes a fixing roller 20*a* and a pressing roller 20*b*.

Substantially above the fixing device 20, a first switching claw 21, a second switching claw 22, a third switching claw 23 to change the transport direction of the recording medium are disposed. The first switching claw 21, the second switching claw 22, the third switching claw 23 are positionable between a position indicated by a solid line and an imaginary line shown in FIG. 4 by an actuator such as a solenoid.

Conveyor roller pairs 24, 25, 26, and 27 are disposed along a sheet transport path to transport the recording medium. Sheet detectors 35, 36, 37, 38, 39, 40, and 41 are disposed along the sheet transport path to detect the recording medium. The sheet transport path is guided by a guide plate or the like.

The upper portion of the main body 50 functions as a sheet output tray 30 onto which the recording medium is output by a pair of output rollers 29. The pair of output rollers 29 is disposed at the upper left of the fixing device 20 in FIG. 2.

In the present illustrative embodiment, a duplex unit 60 is disposed at a lateral side of the main body 50. The duplex unit 60 includes a switchback path 61 and a re-feed path 62.

A pair of first reversing rollers 31 is disposed at an entry portion of the switchback path 61 (i.e., at the upper portion of the duplex unit 60). A pair of second reversing rollers 32 is disposed halfway in the switchback path 61. The pair of first reversing rollers 31 and the pair of second reversing rollers 32 are rotatable in forward and reverse directions. The pair of conveyor rollers 26 (26*a* and 26*b* in FIG. 3) and the pair of conveyor rollers 27 (27*a* and 27*b* in FIG. 3) are disposed at each of three positions of the evenly divided re-feed path 62.

The third switching claw 23 is disposed next to the pair of first reversing rollers 31 at an entry portion of the re-feed path 62 from the switchback path 61.

A side tray 33 is disposed at the lateral side of the duplex unit 60 and storable or folded in as needed. FIG. 2 illustrates the image forming apparatus with the side tray 33 folded out from the lateral side of the duplex unit 60. In order to supply recording media from the side tray 33, the image forming apparatus includes a sheet feed device 34. The sheet feed device 34 is equipped with a pickup roller, a supply roller, and a separation roller. Are-feed roller 28 is disposed at the lateral side of the sheet feed device 34 inside the duplex unit 60.

Driven rollers pressingly contact the re-feed roller 28 from both sides in vertically up and down directions. The re-feed roller 28 is rotatable in both forward and reverse directions. When re-feeding a recording medium from the re-feed path 62, the re-feed roller 28 is driven to rotate in the counterclockwise direction in FIG. 2. When feeding a recording medium from the side tray 33, the re-feed roller 28 is driven to rotate in the clockwise direction in FIG. 2.

Next, a description is provided of an image forming operation. The photosensitive drums 1 in the image forming units 10M, 10C, 10Y, and 10Bk are rotated clockwise by a driving device and charged uniformly to a predetermined polarity by the charging device. The charged surface of each photosensitive drum 1 is illuminated with laser light projected from the optical writing unit 14, to form an electrostatic latent image on the surface of each photosensitive drum 1.

More specifically, upon exposure of the photosensitive drums 1, the image information is separated into individual color components, magenta, cyan, yellow, and black, and laser light based on the single color information thus obtained illuminates the respective photosensitive drum 1. The electrostatic latent images on the photosensitive drums 1 are developed with a respective color of toner by the developing devices 4 into visible images, known as toner images.

As illustrated in FIG. 2, the intermediate transfer belt 11 is rotated in the counterclockwise direction as indicated by arrow. The toner images on the photosensitive drums 1 of the image forming units 10M, 10C, 10Y, and 10Bk are transferred onto the intermediate transfer belt 11 such that they are superimposed one atop the other, thereby forming a composite toner image or a full color image.

The above description pertains to an image forming operation for a color image. It is also possible to form a monochrome image using any one of the four image forming units 10M, 10C, 10Y, and 10Bk, or to form an image of two or three colors by using two or three image forming units. For monochrome printing, the image forming unit 10Bk at the right end side in FIG. 2 is employed.

Subsequently, residual toner remaining on the surface of the photosensitive drums 1 after the toner image is transferred is removed by the cleaning device. After that, the surface potential of the photosensitive drums 1 is initialized by a static eliminator in preparation for the subsequent imaging cycle.

Meanwhile, the recording medium supplied selectively from the sheet cassettes 15*a*, 15*b*, or the side tray 33 is sent out by the pair of registration rollers 18 to the secondary transfer section in appropriate timing such that the recording medium is aligned with the composite image formed on the intermediate transfer belt 11.

According to the present illustrative embodiment, the secondary transfer roller 102 is supplied with the transfer voltage having a polarity opposite the charge polarity of toner of the toner image on the surface of the intermediate transfer belt 11, thereby transferring the toner image from the intermediate transfer belt 11 to the recording medium. As the recording medium on which the toner image is transferred passes through a fixing nip between the fixing roller 20*a* and the pressing roller 20*b* of the fixing device 20, heat and pressure are applied to the recording medium and the toner image is fused thereon, thereby fixing the toner image on the recording medium. After the fixing process, the recording medium is output by the pair of output rollers 29 onto the sheet output tray 30 formed on the upper surface of the main body 50.

For duplex printing, after the image is fixed on one side of the recording medium, the recording medium is sent to the switchback path 61 by switching the first switching claw 21, the second switching claw 22, and the third switching claw 23.

The pair of first reversing rollers 31 and the pair of second reversing rollers 32 are rotated in a forward direction (i.e., the clockwise direction in FIG. 2). When a sheet detector 40 detects that the trailing edge of the recording medium has entered the switchback path 61, the pair of first reversing rollers 31 and the pair of second reversing rollers 32 are rotated in the opposite direction (i.e., the counterclockwise direction in FIG. 2), thereby reversing the recording medium. The reversed recording medium is sent to the re-feed path 62 by switching the third switching claw 23.

The bottom end of the re-feed path 62 joins the sheet transport path from the side tray 33 and further joins the sheet transport path from the sheet cassettes 15*a* and 15*b* at the distal end of the re-feed roller 28. The recording medium is transported by the conveyor rollers 26 and 27 in the re-feed path 62 and further delivered to the pair of registration rollers 18 by the re-feed roller 28.

The recording medium is reversed in the switchback path 61 and then passes through the re-feed path 62. Accordingly, the recording medium is turned over and the toner image is transferred from the intermediate transfer belt 11 onto the back surface of the recording medium. Subsequently, the image on the back surface is fixed by the fixing device 20. The recording medium bearing the images on both sides is output onto the sheet output tray 30. The duplex printing is completed.

According to the present illustrative embodiment, the duplex unit 60 is pivotable about a rotary shaft 63 disposed substantially at the bottom of the duplex unit 60, thereby allowing the duplex unit 60 to be openably closable relative to the main body 50.

Figure 3:
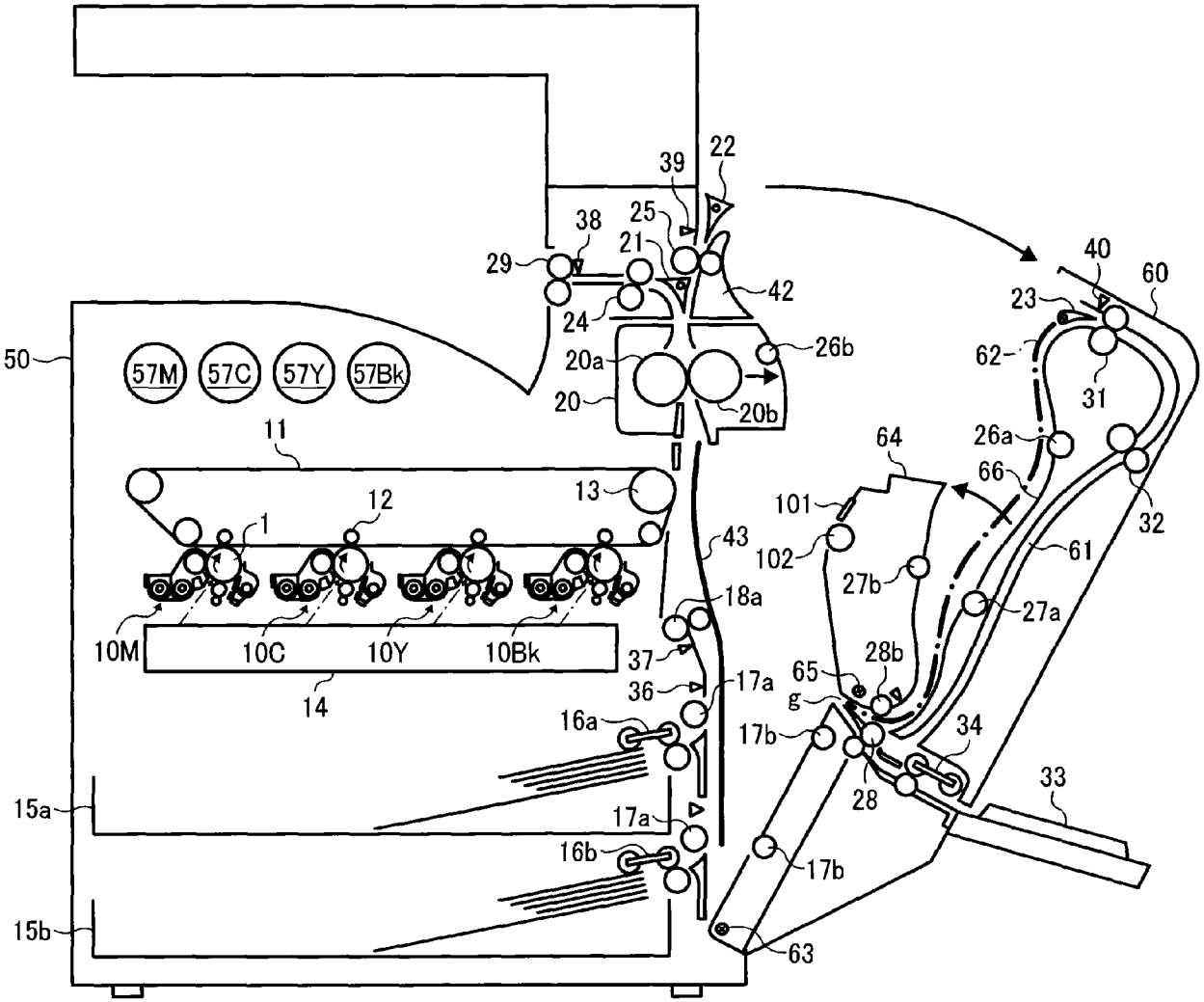
FIG. 3 is a schematic diagram illustrating the image forming apparatus of FIG. 2 with a duplex unit opened.

FIG. 3 illustrates the duplex unit 60 in an opened state. The duplex unit 60 is supported on the main body 50 by an interlocking member. When the duplex unit 60 is opened, the duplex unit 60 is stopped at the predetermined position. In terms of accessibility and replaceability of the secondary transfer roller assembly 100, preferably, the angle at which the duplex unit 60 is opened is equal to or greater than 45 degrees and equal to or less than 90 degrees relative to the vertical direction.

In order to reduce forces to open and close the duplex unit 60, the interlocking member that supports the duplex unit 60 includes, preferably, a damper. Examples of the damper include, but are not limited to an oil damper and a damper using a spring.

Devices included in the duplex unit 60 and openably closable relative to the main body 50 include: a guide plate constituting the switchback path 61, a guide member 66 constituting a portion of the re-feed path 62, a sub-rotary unit 64, the third switching claw 23, the pair of first reversing rollers 31, the pair of second reversing rollers 32, the side tray 33, the sheet feed device 34, the re-feed roller 28, and so forth. The duplex unit 60 also includes driven rollers 17*b* of the pair of conveyor rollers 17.

The sub-rotary unit 64 supports the secondary transfer roller assembly 100, a driven roller 27*b* which is one of the pair of conveyor rollers 27 on the driven side, a driven roller 28*b* which is one of the pair of re-feed rollers 28 on the driven side, and the sheet detector 41 (shown in FIG. 2). The sub-rotary unit 64 is pivotable about a rotary shaft 65. With this configuration, the re-feed path 62 can be opened by rotating the sub-rotary unit 64 in the counterclockwise direction in FIG. 3.

It is to be noted, however, that a stopper of the sub-rotary unit 64 prevents the sub-rotary unit 64 from rotating counterclockwise more than a predetermined angle shown in FIG. 3.

One side (distal side from the main body 50) of the re-feed path 62 is defined by the guide member 66, and the other side (proximal to the inside of the main body 50) is defined by a plane of a guide unit 42, a plane of the fixing device 20, and a plane of the sub-rotary unit 64 in this order from the top. With the duplex unit 60 closed, the re-feed path 62 is formed with the above planes.

With the duplex unit 60 closed as illustrated in FIG. 2, the sub-rotary unit 64 is interposed between the main body 50 and the duplex unit 60, and positioned at a predetermined location.

At this time, the secondary transfer roller 102 of the secondary transfer roller assembly 100 faces the secondary-transfer opposed roller 13 and pressingly contacts the intermediate transfer belt 11. The driven roller 17*b* of each pair of the conveyor rollers 17 pressingly contacts a drive roller 17*a*, and the driven roller 27*b* of the pair of conveyor rollers 27 in the re-feed path 62 pressingly contacts a drive roller 27*a*, thereby enabling operation.

When the duplex unit 60 is opened as illustrated in FIG. 3, the secondary transfer roller assembly 100 separates from the intermediate transfer belt 11 (the secondary-transfer opposed roller 13). As the driven rollers 17*b* of two pairs of the conveyor rollers 17 separate from the drive rollers 17*a*, a normal sheet transport path 43 indicated by a solid bold line in FIG. 3 from the pair of conveyor rollers 17 at the lower portion to the fixing device 20 is opened.

At this time, the re-feed path 62 indicated by a solid long dashed dotted line from the third switching claw 23 to a joining portion G at which the re-feed path 62 joins the normal sheet transport path 43 can be opened as a technician rotates the sub-rotary unit 64 in the opening direction of the re-feed path 62 (in the counterclockwise direction in FIG. 3).

Figure 4:
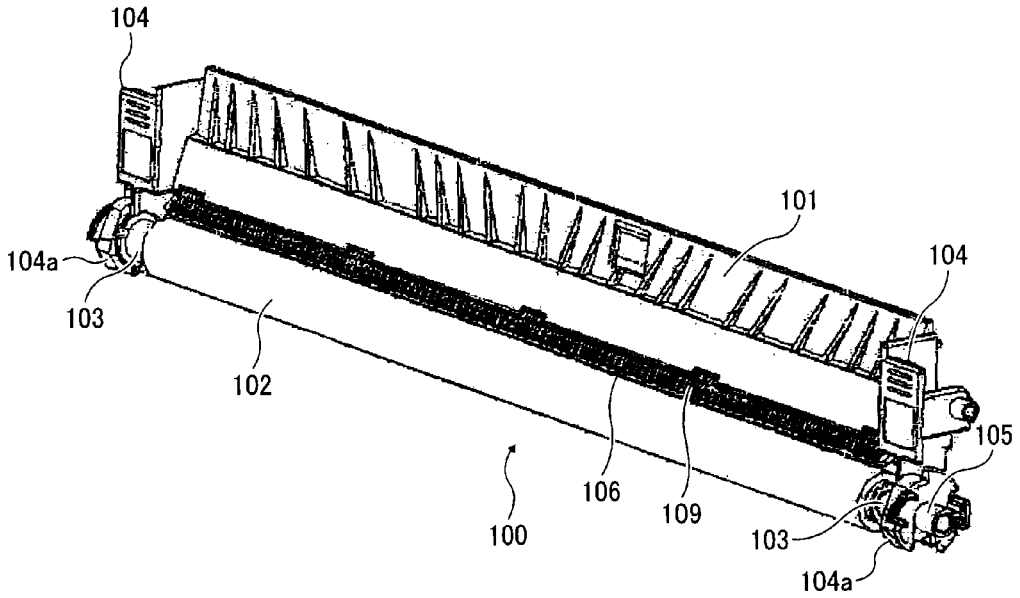
FIG. 4 is a perspective view schematically illustrating a secondary transfer roller assembly detachably attachable relative to a sub-rotatable unit of the duplex unit of FIG. 3.

Next, with reference to FIG. 4, a description is provided of the secondary transfer roller assembly 100. FIG. 4 is an external perspective view schematically illustrating the secondary transfer roller assembly 100 detachably attachable relative to the sub-rotary unit 64.

In the present illustrative embodiment, the secondary transfer roller 102 of the secondary transfer roller assembly 100 includes a roller portion including a metal cored bar made of iron on which an elastic member such as rubber is disposed and two shaft portions 103 which are metal cored bars extending outward from each end of the roller portion.

Figure 5:
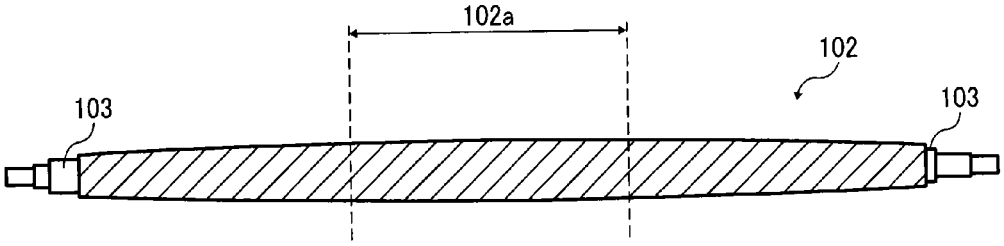
FIG. 5 is an external view schematically illustrating a secondary transfer roller of the secondary transfer roller assembly.

Preferably, the roller portion of the secondary transfer roller 102 is formed in a barrel-like shape as illustrated in FIG. 5. More specifically, the roller portion of the secondary transfer roller 102 includes a substantially straight portion 102*a* (a circumferential surface parallel to the roller shaft) substantially at the center of the roller portion in an axial direction of the roller shaft. Such a barrel-like shape can reduce variations in a nip pressure at the secondary transfer section in the axial direction.

The metal cored bar made of iron can reduce flexure so that the secondary transfer roller 102 and the recording medium can tightly contact each other.

According to the present illustrative embodiment, a roller attachment member 104*a* of a handle 104 is rotatably attached to each of the shaft portions 103 of the secondary transfer roller 102 via a ball bearing. The handle 104 is formed integrally with the guide plate 101.

The shaft portions 103 of the secondary transfer roller 102 extend beyond the roller attachment members 104*a* in the axial direction. A cap 105 serving as a shaft bearing member in a form of a cap is attached to the projecting portions of the shaft portions 103.

The cap 105 is held in place by a holder serving as a roller holder disposed in the main body 50 (i.e., an intermediate transfer unit including the intermediate transfer belt 11). Accordingly, the secondary transfer roller 102 is positioned in place in the vertically up and down directions in the main body 50.

Figure 6A:
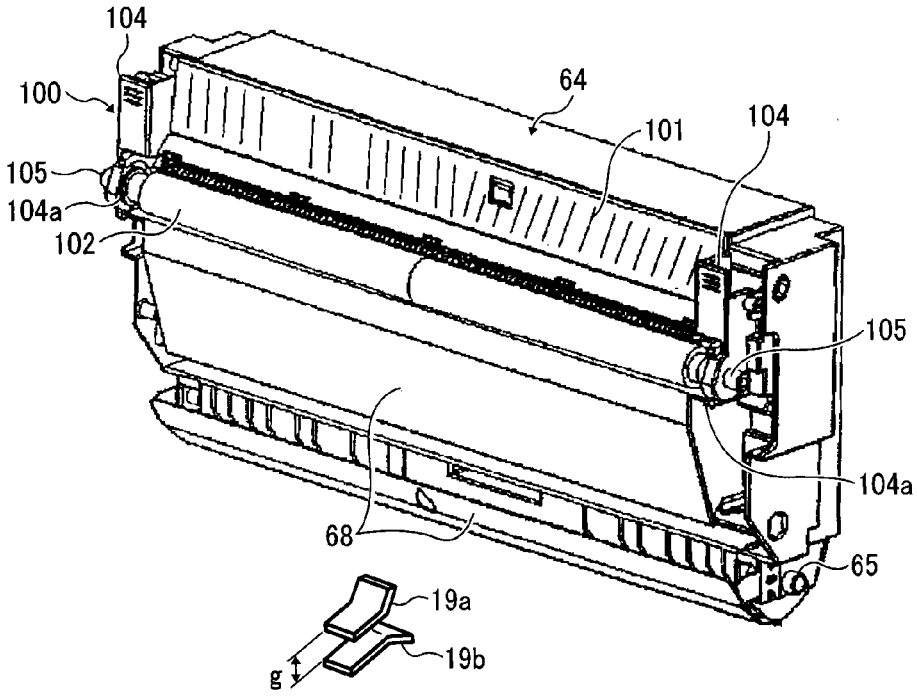
FIG. 6A is an external perspective view schematically illustrating the sub-rotatable unit including the secondary transfer roller assembly as viewed from a main body of the image forming apparatus.
Figure 6B:
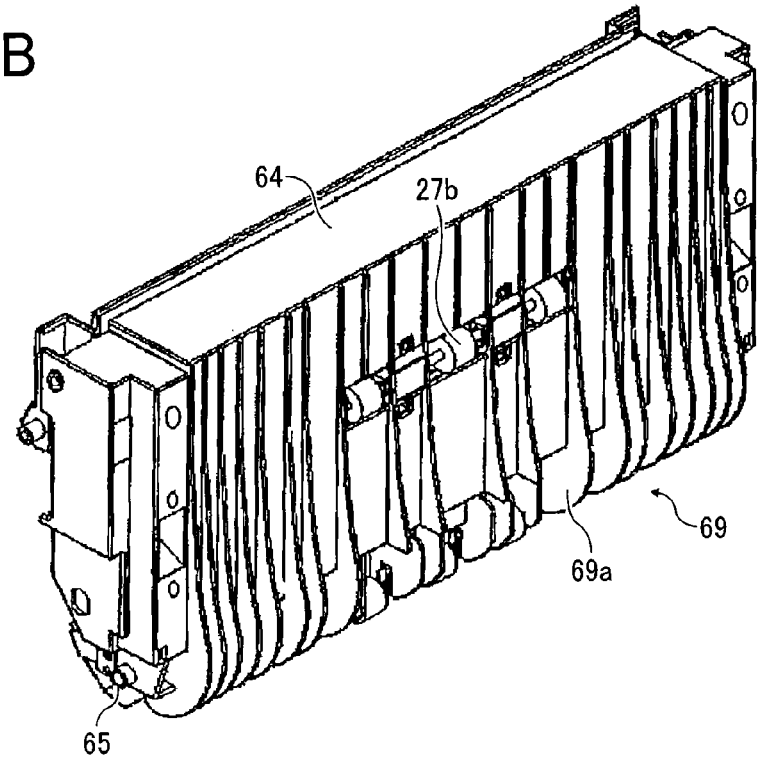
FIG. 6B is an external perspective view schematically illustrating the sub-rotatable unit including the secondary transfer roller assembly as viewed from a re-feed path.

FIGS. 6A and 6B are perspective views schematically illustrating the sub-rotary unit 64 in a state in which the secondary transfer roller assembly 100 is mounted. FIG. 6A illustrates the secondary transfer roller assembly 100 as viewed from the main body 50. FIG. 6B illustrates the secondary transfer roller assembly 100 as viewed from the re-feed path 62. The main body 50 includes holders 19*a* and 19*b* serving as a positioning member to position the secondary transfer roller 102 in place. More specifically, when closing the duplex unit 60 relative to the main body 50, the cap 105 of the secondary transfer roller assembly 100 is interposed between the holders 19*a* and 19*b*, hence positioning the secondary transfer roller 102 in place. It is to be noted that FIG. 6A illustrates only the parts on the right side.

The space between the holders 19*a* and 19*b* increases towards the leading end thereof. At the other end or the trailing end a space g is provided in accordance with the outer diameter of the cap 105.

The secondary transfer roller assembly 100 is snap-fitted to the sub-rotary unit 64 such that when the duplex unit 60 is closed a sheet guiding surface of the guide plate 101 conforms to the normal sheet transport path 43 (shown in FIG. 3).

As illustrated in FIG. 6A, a guide plate 68 is attached to the sub-rotary unit 64 at the main body side below the secondary transfer roller assembly 100. The guide plate 68 and a guide plate opposite to the guide plate 68 at the main body side constitute a portion of the normal sheet transport path 43 (shown in FIG. 3).

As illustrated in FIG. 6B, the sub-rotary unit 64 provided with the driven roller 27*b* on the re-feed path 62 side includes a conveyor guide surface 69 with a plurality of ribs 69*a*. The sub-rotary unit 64 at the re-feed path side and the guide member 66 (shown in FIG. 3) opposite of the sub-rotary unit 64 constitute a portion of the re-feed path 62.

Figure 7:
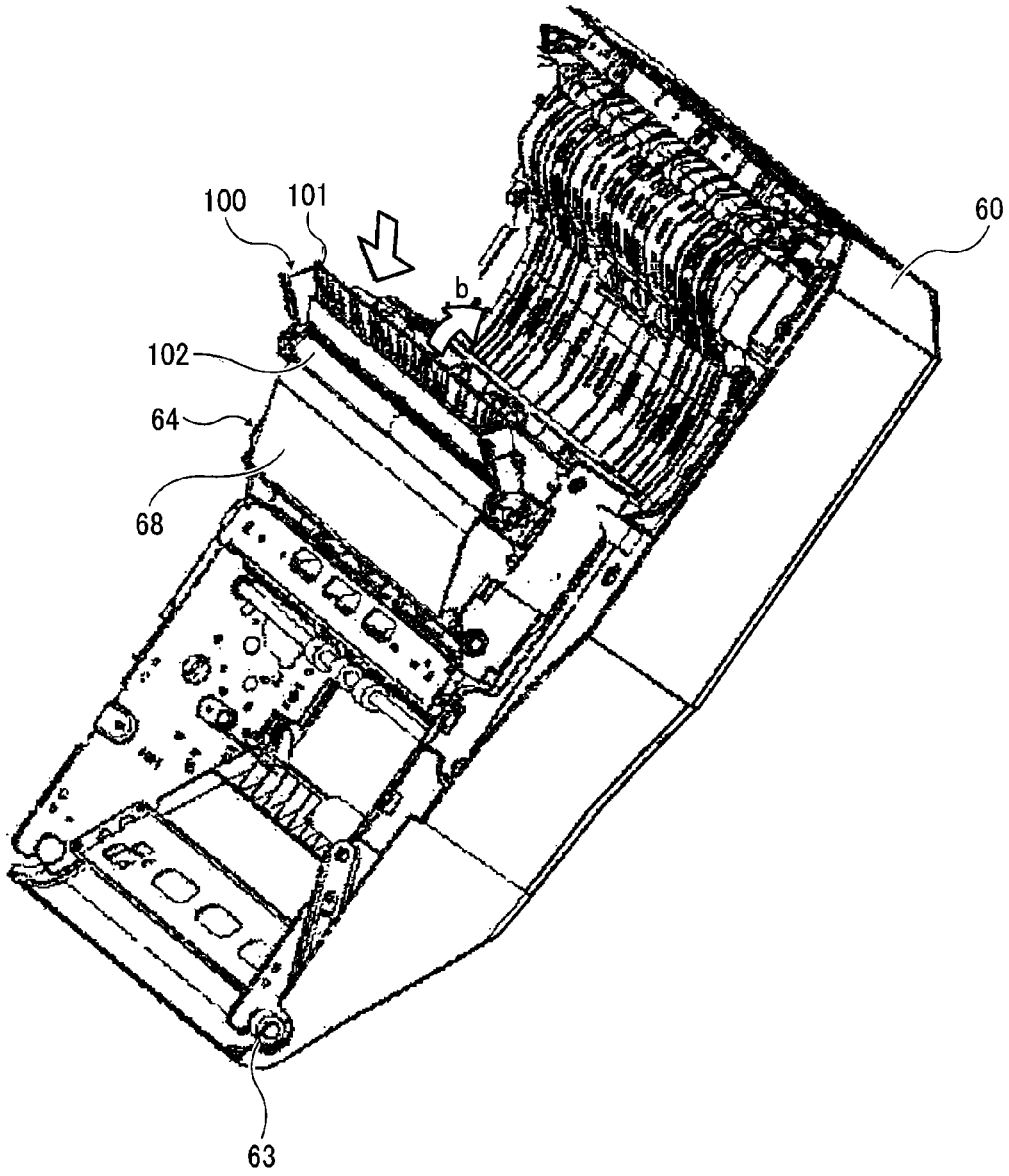
FIG. 7 is a schematic diagram illustrating the secondary transfer roller assembly when the secondary transfer roller assembly is mounted in the sub-rotatable unit.

Next, with reference to FIG. 7, a description is provided of replacement of the secondary transfer roller assembly 100. FIG. 7 illustrates the secondary transfer roller assembly 100 when mounting in the sub-rotary unit 64.

Upon replacement of the secondary transfer roller assembly 100, a technician opens the duplex unit 60 to expose the sub-rotary unit 64 as illustrated in FIG. 3. At this time, the secondary transfer roller assembly 100 is snap-fitted to the sub-rotary unit 64.

The technician holds and moves the guide plate 101 or the handle 104 to the main body 50 side (in the opposite direction to the direction indicated by a hollow arrow b in FIG. 7), thereby unlocking the secondary transfer roller assembly 100 and hence allowing the secondary transfer roller assembly 100 to become rotatable while the roller attachment member 104*a* of the handle 104 is held by a roller bearer of the sub-rotary unit 64.

Subsequently, the secondary transfer roller assembly 100 is rotated until the sheet guide surface of the guide plate 101 is substantially parallel to the vertical plane, and then the technician lifts up vertically while holding the guide plate 101 or the handle 104.

Accordingly, the roller attachment member 104*a* of the handle 104 is disengaged from the roller bearer of the sub-rotary unit 64, and the secondary transfer roller assembly 100 is disengaged from the sub-rotary unit 64.

After the secondary transfer roller assembly 100 is removed from the sub-rotary unit 64, a new secondary transfer assembly for replacement is mounted in the sub-rotary unit 64 in reverse order of the above-described order.

Figure 8:
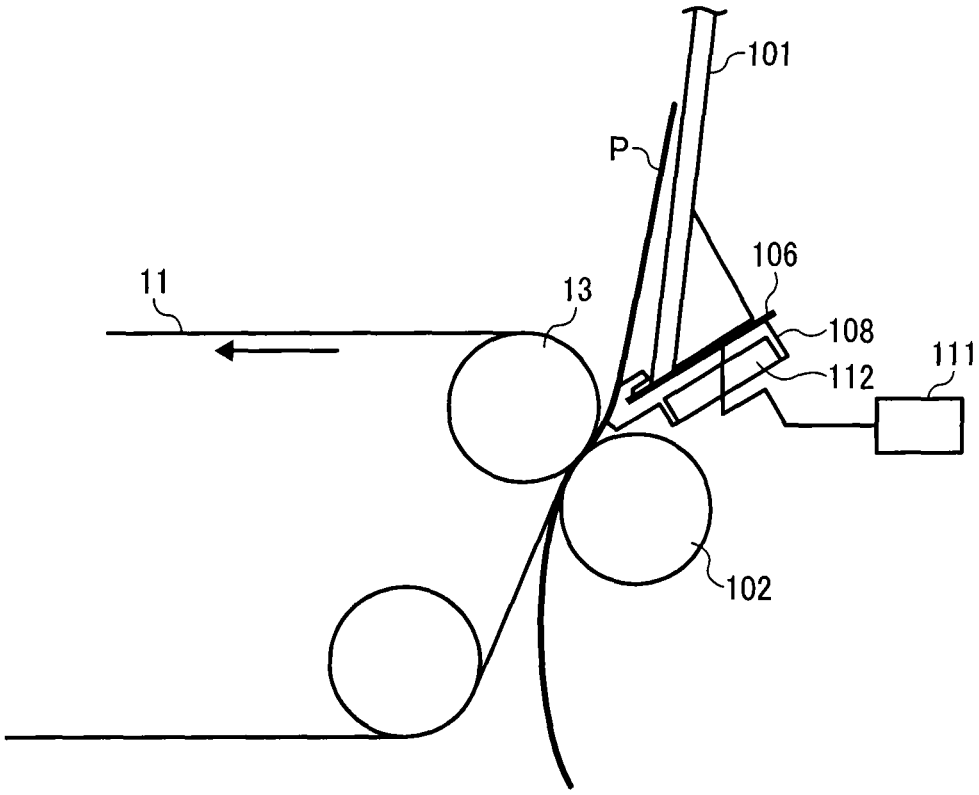
FIG. 8 is a partially enlarged schematic diagram illustrating a secondary transfer section.

Next, with reference to FIG. 8, a description is provided of a static eliminating portion as a static eliminator employed in the secondary transfer roller assembly 100 according to an illustrative embodiment of the present disclosure.

FIG. 8 is a partially enlarged schematic diagram illustrating the secondary transfer section. As illustrated in FIG. 8, the static eliminating portion including a static eliminating plate 106 for eliminating static charges on the recording medium is disposed near a secondary transfer nip at which the intermediate transfer belt 11 and the secondary transfer roller 102 contact, i.e., downstream from the secondary transfer nip in the transport direction of the recording medium.

A spring 112 for supplying power, connected to a power source 111 of the main body 50, contacts a bottom surface of the static eliminating plate 106 at one end thereof in the width direction of the recording medium, thereby supplying a voltage for static removal to the static eliminating plate 106.

As the duplex unit 60 is opened relative to the main body 50, the guide plate 101 and the static eliminating plate 106 move together with the duplex unit 60.

Embodiment 1

With reference to FIGS. 1A, 1B, 9, and 10, a description is provided of a static eliminating portion according to a first illustrative embodiment of the present disclosure.

Figure 9:
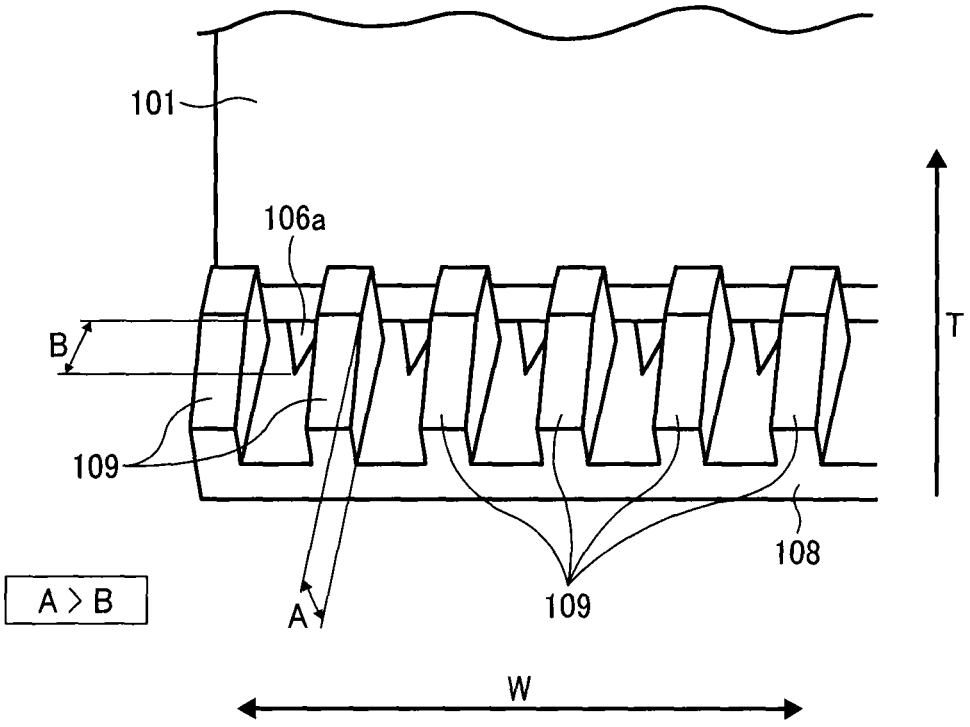
FIG. 9 is a perspective view schematically illustrating an end of the static eliminating portion in a width direction of a recording medium according to the first illustrative embodiment of the present disclosure.

FIG. 9 is a perspective view schematically illustrating an end portion of the static eliminating portion including the static eliminating plate 106 in a width direction W of a recording medium, according to the first illustrative embodiment of the present disclosure. In the present illustrative embodiment, the static eliminating portion is disposed at the bottom end (the upstream end in the transport direction indicated by arrow T of the recording medium) of the guide plate 101 of the secondary transfer roller assembly 100.

Figure 1B:
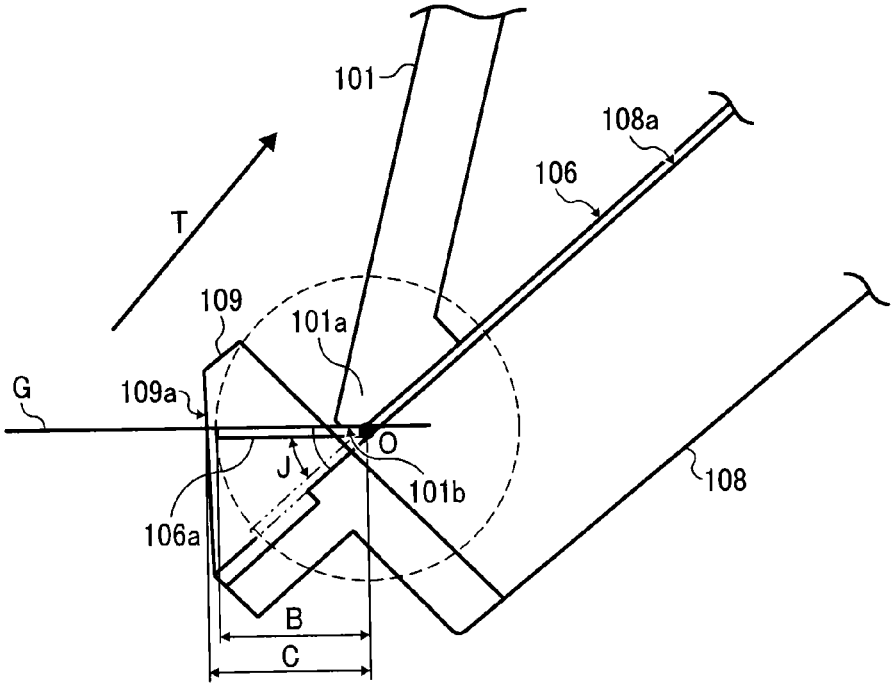
FIG. 1B is a cross-sectional view schematically illustrating the static eliminating portion in a state in which the tip of the static eliminating needle of the first illustrative embodiment is bent.
Figure 10:
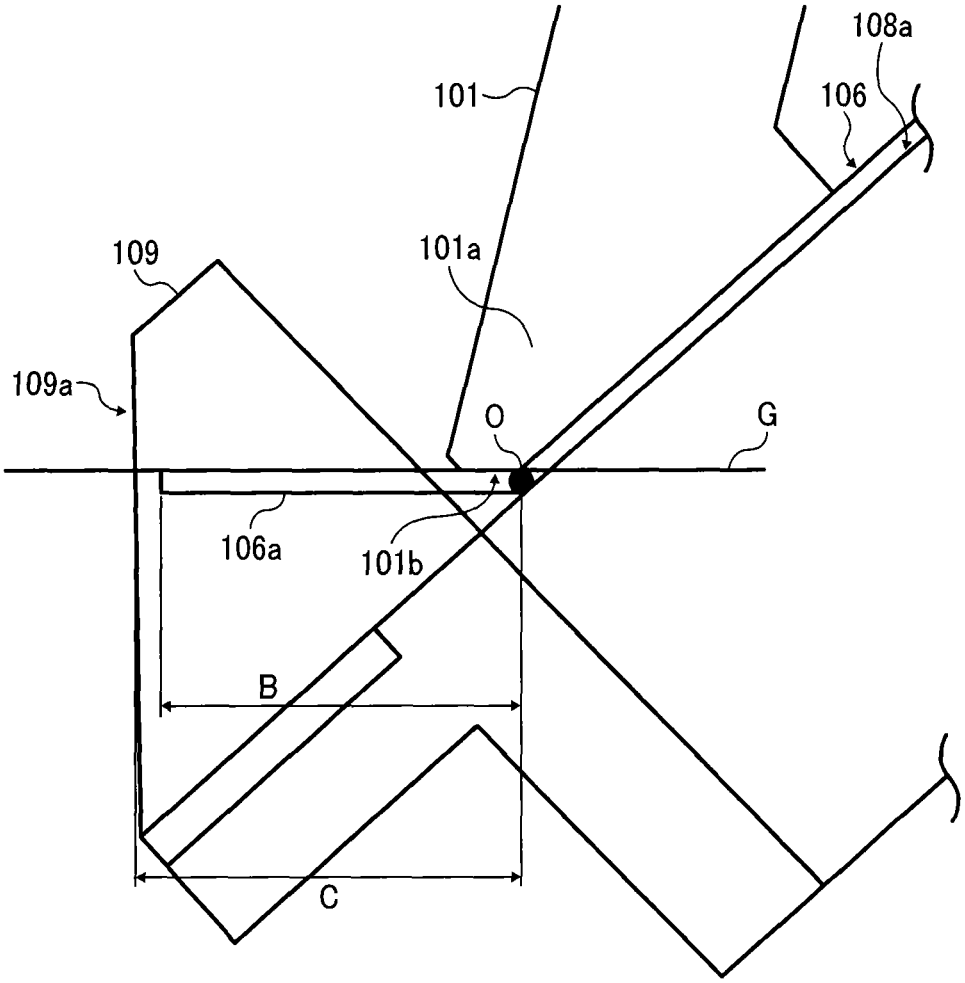
FIG. 10 is an enlarged schematic diagram illustrating

FIG. 1A is a cross-sectional view schematically illustrating the static eliminating plate 106 in a state in which a leading end of a static eliminating needle 106*a* of the static eliminating plate 106 is at a default position according to the first illustrative embodiment of the present disclosure. FIG. 1B is a cross-sectional view schematically illustrating the static eliminating portion in a state in which the tip of the static eliminating needle 106*a* of FIG. 1A is bent. FIG. 10 is an enlarged view schematically illustrating the static eliminating portion of FIG. 1B.

According to the present illustrative embodiment, the static eliminating portion includes the static eliminating plate 106 equipped with a plurality of static eliminating needles (sharp tip portions) 106*a* arranged in the width direction of the recording medium (indicated by arrow W in the left-right direction in FIG. 9). The static eliminating plate 106 is conductive, and the static eliminating needles 106*a* face the sheet transport path after the recording medium passes through the secondary transfer section. The static eliminating needles 106*a* are arranged in the width direction of the recording medium. The leading ends of the static eliminating needles 106*a*, which are free ends, face the surface of the recording medium conveyed along the sheet transport path.

The static eliminating plate 106 is attached to a retaining surface 108*a* of a non-conductive plate holder 108 such that each of the static eliminating needles 106*a* is disposed spaced apart a predetermined distance from the sheet transport path.

The static eliminating needles 106*a* are interposed between a bottom end portion 101*a* of the guide plate 101 and the retaining surface 108*a* of the plate holder 108. The guide plate 101 also serves as a pressing member to press the static needles 106*a* against the retaining surface 108*a*.

An insulating sheet formed of polyethylene terephthalate (PET) or the like may be disposed between the bottom end of the guide plate 101 and the static eliminating needles 106*a* to press the static eliminating needles 106*a* against the retaining surface 108*a* more reliably, hence preventing the static eliminating needles 106*a* from separating.

The plate holder 108 may be made of resin similar to or the same resin as the guide plate 101. However, any other suitable material can be employed as long as the material is non-conductive.

As illustrated in FIG. 9, ribs 109 that are non-conductive are formed on the retaining surface 108*a* of the plate holder 108. The ribs 109 contact a portion of the recording medium that has passed through the secondary transfer section so as to guide the recording medium. The ribs 109 partition each of the static eliminating needles 106*a* in a width direction W of the recording medium.

The ribs 109 are formed in a standing manner at predetermined intervals between each other on the retaining surface 108*a* of the plate holder 108 in the width direction W of the recording medium. Each static eliminating needle 106*a* of the static eliminating plate 106 is disposed between the ribs 109.

However, the distance between the static eliminating needle 106*a* and the transport path is greater than the distance between the rib 109 and the sheet transport path. That is, the ribs 109 are disposed closer to the sheet transport path than from the static eliminating needles 106*a* of the static eliminating plate 106 so that the static eliminating needles 106*a* are prevented from contacting the recording medium.

In other words, as illustrated in FIG. 1A, the static eliminating needles 106*a* are disposed on the retaining surface 108*a* of the plate holder 108 in such a manner that the leading ends of the static eliminating needles 106*a* do not project beyond the ribs 109. For example, the distance from the leading end of the static eliminating needle 106*a* to the leading end (an end surface 109*a*) of the rib 109 is equal to or less than 3 mm. This position is a default position for the leading end of the static eliminating needle 106*a*.

As the ribs 109 are formed in a standing manner to interpose the static eliminating needles 106*a* in the width direction of the recording medium, the ribs 109 prevent the static eliminating needles 106*a* from contacting the recording medium and keep fingers of the technician from the static eliminating needles 106*a* when clearing paper jams.

When the leading end of the static eliminating needle 106*a* is bent at the bottom end portion 101*a* of the guide plate 101 as the origin O as illustrated in FIGS. 1B and 10, a degree of bent of the static eliminating needle 106*a* is regulated by an end surface 101*b* of the bottom end portion 101*a*.

In this configuration, an amount of projection, which is a length from the bottom end portion 101*a* as the origin to the leading end of the static eliminating needle 106*a*, is shorter than a distance from the origin to the end surface 109*a* of the rib 109 within an angle between an imaginary plane G including the end surface 101*b* and the retaining surface 108*a*.

In other words, when the static eliminating needle 106*a* is bent, the leading end of the static eliminating needle 106*a* does not project beyond the end surface 109*a* of the rib 109 within a range of movement (within a movement locus) J of the leading end of the static eliminating needle 106*a* from the default position (the retaining surface 108*a*) to the standing position corresponding to the end surface 101*b*. The reference letter J refers to the range of movement of the static eliminating needle 106*a* when the static eliminating needle 106*a* is bent.

According to the present illustrative embodiment, as illustrated in FIG. 9, an amount of projection B of the static eliminating needle 106*a* projecting from the bottom end portion 101*a* of the guide plate 101 is less than a height A of the rib 109 from the retaining surface 108*a*.

Furthermore, as illustrated in FIGS. 1B and 10, the amount of projection B of the static eliminating needle 106*a* projecting from the bottom end portion 101*a* of the guide plate 101 is less than a distance C from the origin O to the end surface 109*a* of the rib 109 in the range of movement of the leading end of the static eliminating needle 106*a* which is bent at the origin O.

With this configuration, even when clothes of the technician are caught by the static eliminating needle 106*a* and thus the static eliminating needle 106*a* is bent, the leading end of the static eliminating needle 106*a* does not project beyond the end surface 109*a* of the rib 109. The rib 109 prevents the leading end of the static eliminating needle 106*a* from contacting the recording medium, thereby keeping the static eliminating needle 106*a* from damage.

In a case in which clothes of the technician are caught, thus applying an external force to the static eliminating needle 106*a* and bending the static eliminating needle 106*a* to the end surface 101*b*, when the external force is eliminated the leading end of the static eliminating needle 106*a* springs back a little due to resilience of the static eliminating needle 106*a*.

In view of the above, the amount of projection of the static eliminating needle 106*a* is less than the distance from the origin O to the end surface 109*a* within a range from the retaining surface 108*a* up to at least a position approximately five degrees (5°) below the end surface 101*b* (imaginary plane G) in an angle between the imaginary plane G and the retaining surface 108*a*.

In other words, the leading end of the static eliminating needle 106*a* is configured not to project beyond the end surface 109*a* of the rib 109 within the range of movement (movement locus) of the leading end of the static eliminating needle 106*a* from the default position to the position five degrees (5°) below the end surface 101*b* (imaginary plane G).

Preferably, at least the leading end of the static eliminating needle 106*a* is configured not to project beyond the end surface 109*a* of the rib 109 within the range of movement (movement locus) of the leading end of the static eliminating needle 106*a* up to the position two degrees (2°) below the end surface 101*b* (imaginary plane G). More preferably, at least the leading end of the static eliminating needle 106*a* is configured not to project beyond the end surface 109*a* of the rib 109 within the range of movement (movement locus) of the leading end of the static eliminating needle 106*a* up to the position one degree (1°) below the end surface 101*b* (imaginary plane).

Embodiment 2

Figure 11:
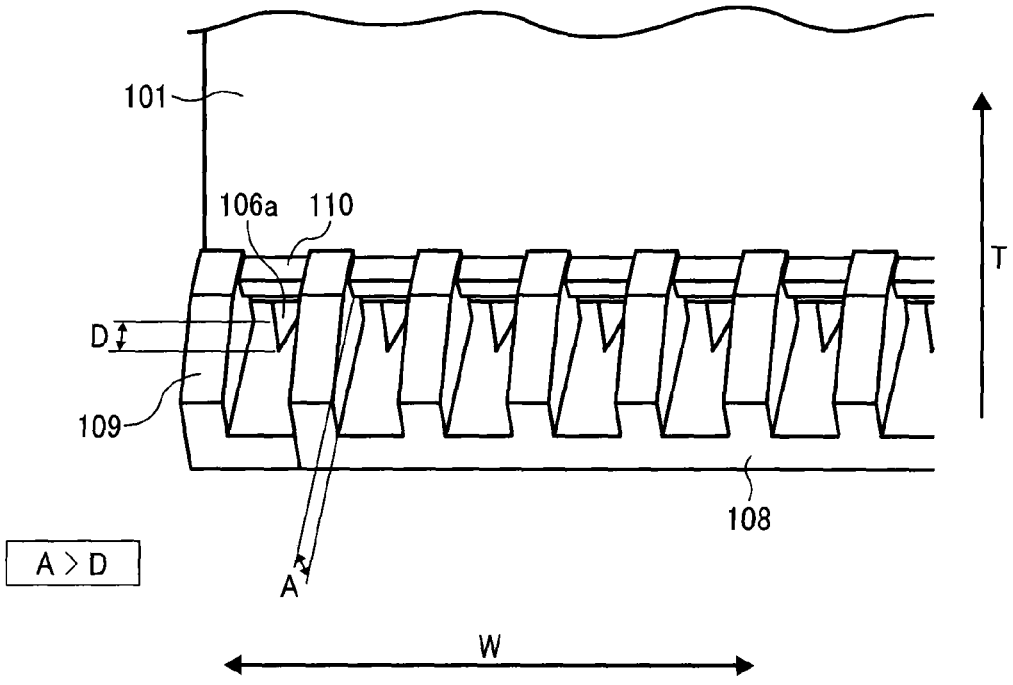
FIG. 11 is a perspective view schematically illustrating an end of the static eliminating portion in the width direction of the recording medium according to a second illustrative embodiment of the present disclosure.
Figure 12A:
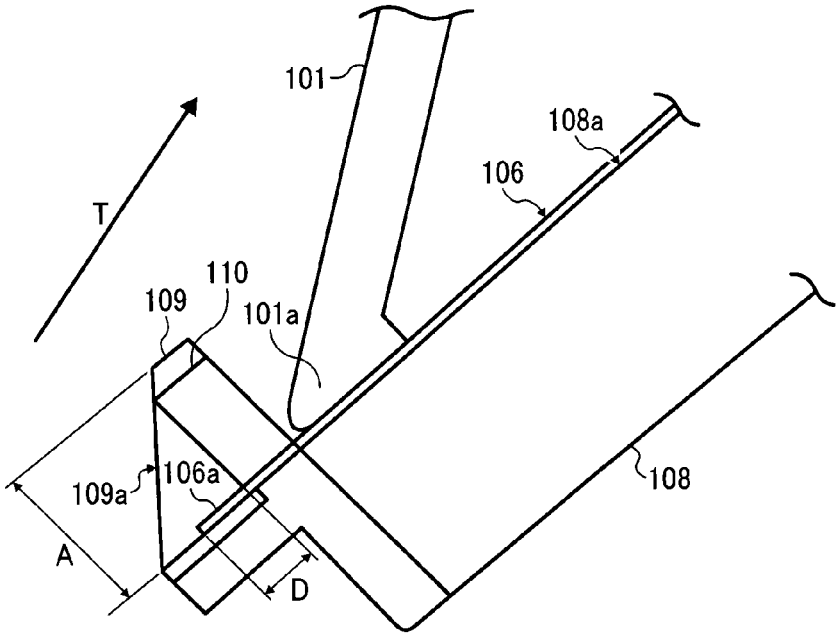
FIG. 12A is a cross-sectional view schematically illustrating the static eliminating portion in a state in which the tip of the static eliminating needle is at the default position according to the second illustrative embodiment of the present disclosure.
Figure 12B:
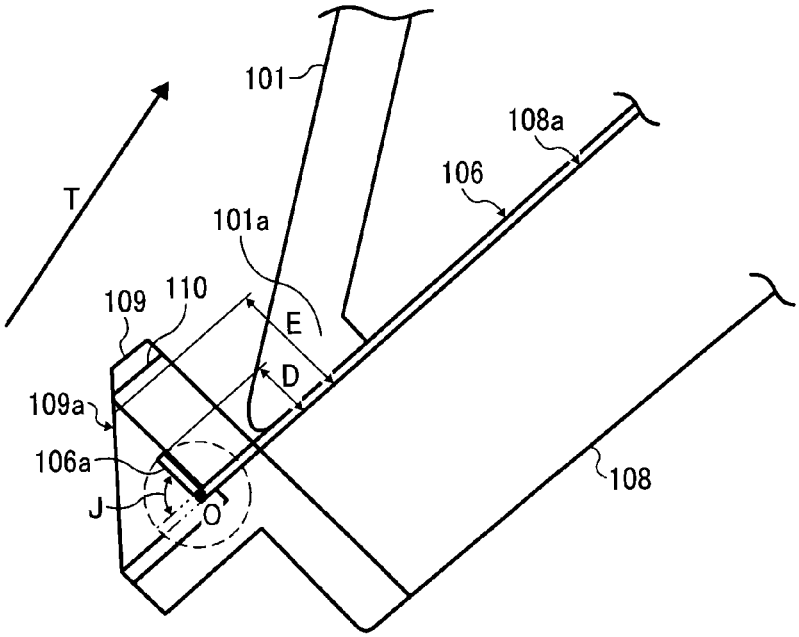
FIG. 12B is a cross-sectional view schematically illustrating the static eliminating portion in a state in which the tip of the static eliminating needle of the second illustrative embodiment is bent.

With reference to FIGS. 11 through 12B, a description is provided of a second illustrative embodiment of the present disclosure. FIG. 11 is a perspective view schematically illustrating an end portion of the static eliminating portion disposed at the bottom end of the guide plate 101 in the width direction W of recording medium according to the second illustrative embodiment of the present disclosure.

FIG. 12A is a cross-sectional view schematically illustrating the static eliminating portion in a state in which the leading end of a static eliminating needle 106*a* is at the default position according to the second illustrative embodiment of the present disclosure. FIG. 12B is a cross-sectional view schematically illustrating the static eliminating portion in a state in which the tip of the static eliminating needle 106*a* of the second illustrative embodiment is bent.

According to the present illustrative embodiment, as illustrated in FIG. 11, projections 110 that contact the ribs 109 in the width direction W of the recording medium are disposed upstream from the end surface 101*b* of the guide plate 101 in the transport direction T of the recording medium above the static eliminating needles 106*a* (i.e., at a position facing the retaining surface 108*a* via the static eliminating needles 106*a*). In the present illustrative embodiment, the projections 110 serve as a restriction member to restrict movement of the static eliminating needles 106*a*, and the guide plate 101 serves as a pressing member to press the static eliminating needles 106*a* against the retaining surface 108*a*.

As illustrated in FIG. 12A, the projection 110 contacts the static eliminating needle 106*a*. In this configuration, the static eliminating needle 106*a* is interposed not only between the retaining surface 108*a* of the plate holder 108 and the guide plate 101, but also between the retaining surface 108*a* and the projection 110.

With the projection 110, the free length (a length at which the static eliminating needle 106*a* can bend) of the static eliminating needle 106*a* can be shorter than that without the projection 110, without changing the place of installation of the guide plate 101.

According to the present illustrative embodiment, as illustrated in FIGS. 11 and 12A, an amount of projection D of the static eliminating needle 106*a* from the bottom end portion of the projection 110 is less than the height A of the rib 109 from the retaining surface 108*a*.

Furthermore, as illustrated in FIG. 12B, the amount of projection D of the leading end of the static eliminating needle 106*a* from the projection 110 is less than a distance E from the bottom end portion of the projection 110 as the origin O at which the static eliminating needle 106*a* is bent to the end surface 109*a* of the rib 109 in the range of movement of the leading end of the static eliminating needle 106*a* which is bent at the origin O.

With this configuration, even when the static eliminating needle 106*a* is bent, the leading end of the static eliminating needle 106*a* does not project beyond the end surface 109*a* of the rib 109, hence preventing the leading end of the static eliminating needle 106*a* from contacting the recording medium.

It is to be noted that a gap may be provided between the static eliminating needle 106*a* and the projection 110. In this configuration, the static eliminating needle 106*a* can contact air easily, thereby increasing static elimination efficiency, as compared with the static eliminating needle 106*a* contacting the projection 110.

Embodiment 3

Figure 13:
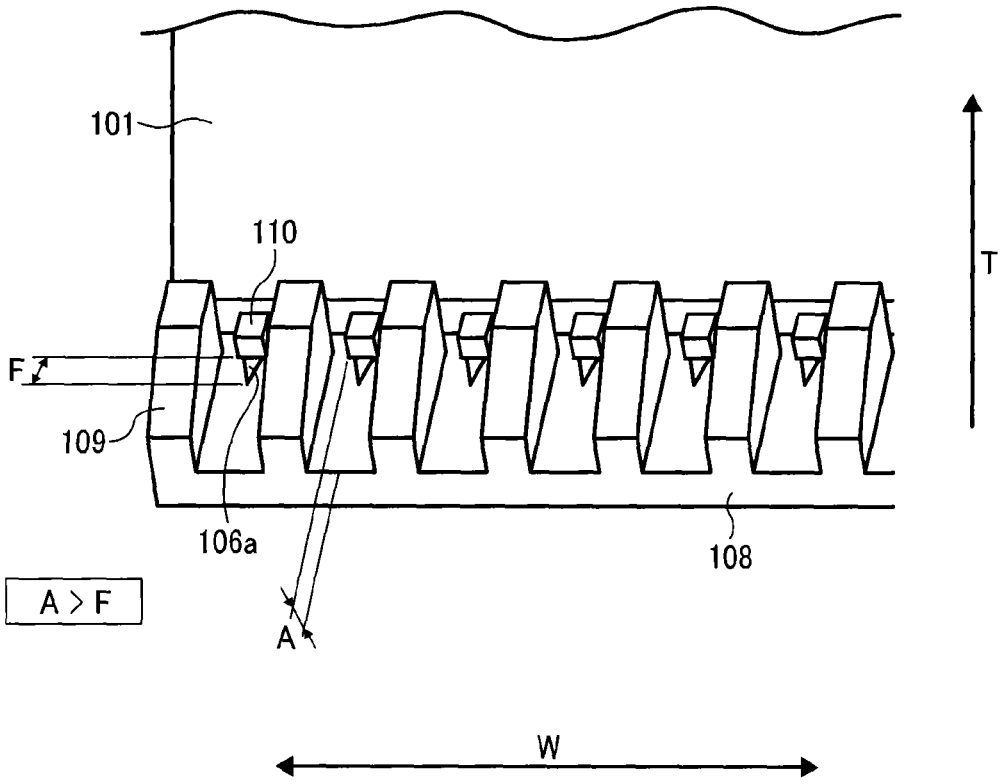
FIG. 13 is a perspective view schematically illustrating an end of the static eliminating portion in the width direction of the recording medium according to a third illustrative embodiment of the present disclosure.
Figure 14A:
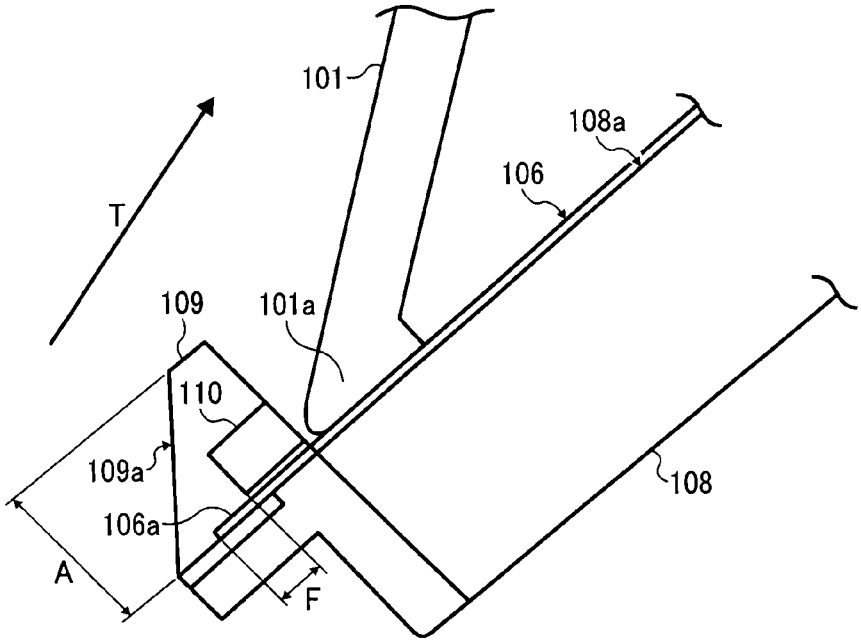
FIG. 14A is a cross-sectional view schematically illustrating the static eliminating portion in a state in which the tip of the static eliminating needle is at the default position according to a third illustrative embodiment of the present disclosure.
Figure 14B:
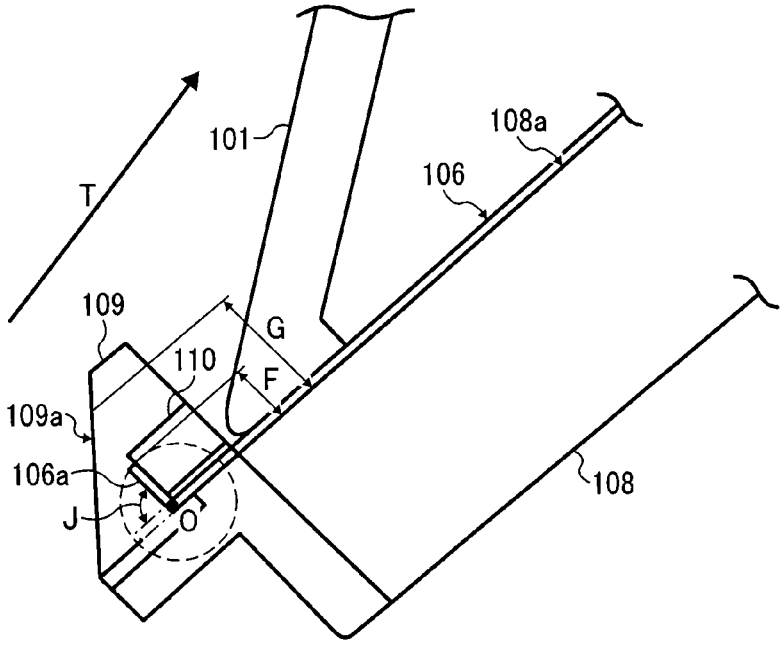
FIG. 14B is a cross-sectional view schematically illustrating the static eliminating portion in a state in which the tip of the static eliminating needle of the third illustrative embodiment is bent.

With reference to FIGS. 13 through 14B, a description is provided of a third illustrative embodiment of the present disclosure. FIG. 13 is a perspective view schematically illustrating the end portion of the static eliminating portion in the width direction W of the recording medium according to the first illustrative embodiment of the present disclosure. In the present illustrative embodiment, the static eliminating portion is disposed at the bottom end of the guide plate 101.

FIG. 14A is a cross-sectional view schematically illustrating the static eliminating portion in a state in which a leading end of a static eliminating needle 106*a* at the static eliminating portion is at the default position according to the third illustrative embodiment of the present disclosure. FIG. 14B is a cross-sectional view schematically illustrating the static eliminating portion in a state in which the tip of the static eliminating needle 106*a* of FIG. 14A is bent.

According to the present illustrative embodiment, as illustrated in FIG. 13, the projections 110 are disposed upstream from the end surface 101*b* of the guide plate 101 in the transport direction T of the recording medium above the static eliminating needles 106*a* (i.e., at a position facing the retaining surface 108*a* via the static eliminating needles 106*a*) in such a manner that the projections 110 do not contact the ribs 109.

In this configuration, there is a space between projection 110 and the rib 109 so that the static eliminating needle 106*a* can contact air easily, thereby increasing static elimination efficiency, as compared with the projection 110 contacting the rib 109 in the width direction of the recording medium.

As illustrated in FIG. 14A, there is a space between the static eliminating needle 106*a* and the projection 110. In this configuration, the static eliminating needle 106*a* can contact air easily, thereby increasing static elimination efficiency, as compared with the static eliminating needle 106*a* contacting the projection 110.

According to the present illustrative embodiment, as illustrated in FIGS. 13 and 14A, an amount of projection F of the static eliminating needle 106*a* from the bottom end portion of the projection 110 is less than the height A of the rib 109 from the retaining surface 108*a*.

Furthermore, as illustrated in FIG. 14B, the amount of projection F of the leading end of the static eliminating needle 106*a* from the projection 110 is less than a distance G from the bottom end portion of the projection 110 as the origin O at which the static eliminating needle 106*a* is bent to the end surface 109*a* of the rib 109 in the range of movement of the leading end of the static eliminating needle 106*a* which is bent at the origin O.

With this configuration, even when the static eliminating needle 106*a* is bent, the leading end of the static eliminating needle 106*a* does not project beyond the end surface 109*a* of the rib 109, hence preventing the leading end of the static eliminating needle 106*a* from contacting the recording medium.

Alternatively, the static eliminating needle 106*a* and the projection 110 may be in contact with each other, and the static eliminating needle 106*a* is interposed not only between the retaining surface 108*a* of the plate holder 108 and the guide plate 101, but also between the retaining surface 108*a* and the projection 110.

Embodiment 4

Figure 15A:
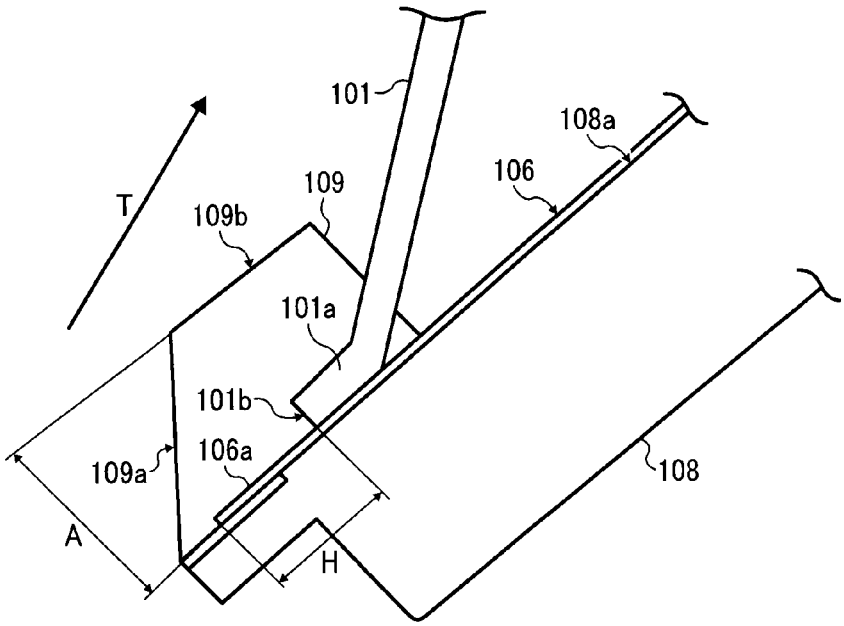
FIG. 15A is a cross-sectional view schematically illustrating the static eliminating portion in a state in which the tip of the static eliminating needle is at the default position according to a fourth illustrative embodiment of the present disclosure.
Figure 15B:
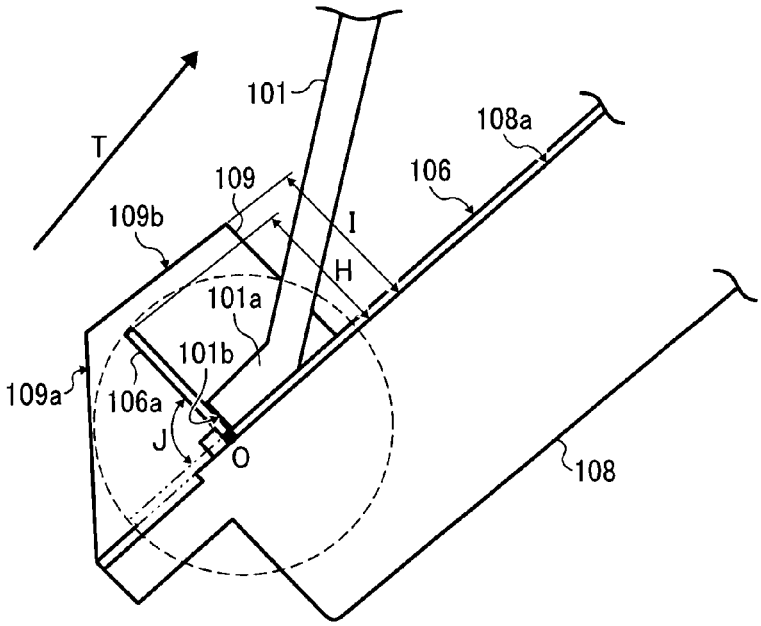
FIG. 15B is a cross-sectional view schematically illustrating the static eliminating portion in a state in which the tip of the static eliminating needle of the fourth illustrative embodiment is bent.

With reference to FIGS. 15A and 15B, a description is provided of a fourth illustrative embodiment of the present disclosure. FIG. 15A is a cross-sectional view schematically illustrating the static eliminating portion in a state in which the leading end of the static eliminating needle 106*a* at the static eliminating portion is at the default position according to the fourth illustrative embodiment of the present disclosure. FIG. 15B is a cross-sectional view schematically illustrating the static eliminating portion in a state in which the tip of the static eliminating needle 106*a* of FIG. 15A is bent.

According to the present illustrative embodiment, as illustrated in FIG. 15A, the end surface 101*b* of the bottom end portion 101*a* of the guide plate 101 is disposed perpendicular to the retaining surface 108*a*. The rib 109 extends to the rear end portion of the static eliminating needle 106*a*, farther than the bottom end portion 101*a* of the guide plate 101 which is the origin O at which the static eliminating needle 106*a* is bent.

As illustrated in FIG. 15A, the static eliminating needle 106*a* is disposed on the retaining surface 108*a* of the plate holder 108 in such a manner that the leading end of the static eliminating needle 106*a* does not project beyond the rib 109. This position is the default position for the leading end of the static eliminating needle 106*a*.

When the leading end of the static eliminating needle 106*a* is bent at the bottom end portion 101*a* of the guide plate 101 as the origin O as illustrated in FIG. 15B, a degree of bent of the static eliminating needle 106*a* is regulated by the end surface 101*b* of the guide plate 101.

Accordingly, when the static eliminating needle 106*a* is bent, the leading end of the static eliminating needle 106*a* does not project beyond the end surface 109*a* of the rib 109 within the range of movement (within the movement locus) J of the leading end of the static eliminating needle 106*a* from the default position (the retaining surface 108*a*) to the standing position corresponding to the end surface 101*b*.

According to the present illustrative embodiment, as illustrated in FIG. 15A, an amount of projection H of the static eliminating needle 106*a* from the bottom end portion 101*a* of the guide plate 101 is less than the height A of the rib 109 from the retaining surface 108*a*.

Furthermore, the amount of projection H of the leading end of the static eliminating needle 106*a* from the bottom end portion 101*a* is less than a distance I from the origin O to the end surface 109*a* and an end surface 109*b* of the rib 109 in the range of movement of the leading end of the static eliminating needle 106*a* bent at the origin O from the default position to the end surface 101*b*.

With this configuration, even when the static eliminating needle 106*a* is bent, the leading end of the static eliminating needle 106*a* does not project beyond the end surfaces 109*a* and 109*b* of the rib 109 within the above-described range of movement.

Figure 16:
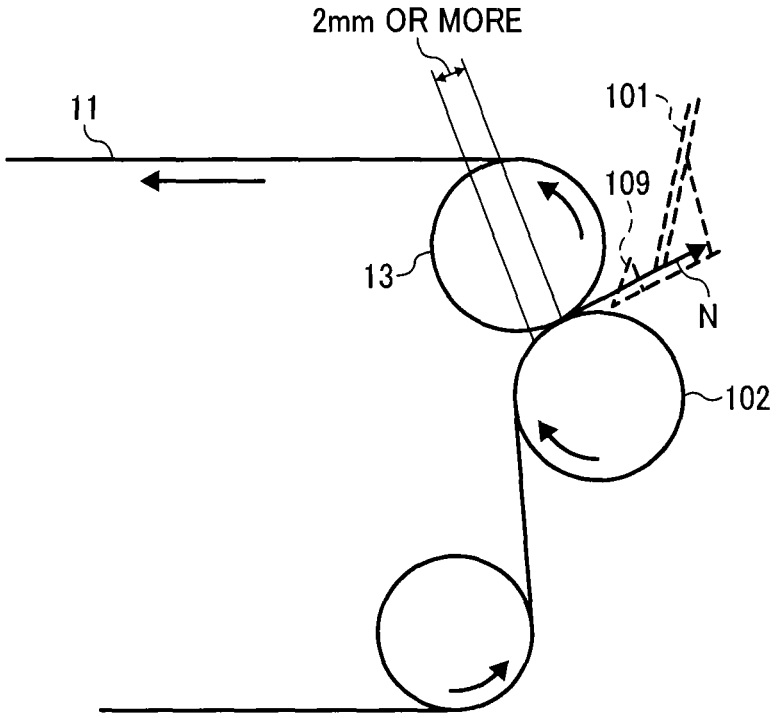
FIG. 16 is a schematic diagram illustrating the secondary transfer section.

According to the present illustrative embodiment, as illustrated in FIG. 16, the secondary transfer roller 102 is disposed substantially below the secondary-transfer opposed roller 13 via the intermediate transfer belt 11. With this configuration, the output direction of the recording medium coincides with the direction of the guide plate 101, thereby conveying the recording medium with accuracy relative to the leading end of the static eliminating needle 106*a* fixed to the guide plate 101 and hence eliminating static charges on the recording medium accurately. Scattering of toner is prevented.

According to the present illustrative embodiment, as illustrated in FIG. 16, the secondary transfer roller 102 is disposed upstream from the secondary-transfer opposed roller 13 in the traveling direction of the intermediate transfer belt 11 so that the secondary transfer roller 102 contacts the intermediate transfer belt 11 before the secondary-transfer opposed roller 13 contacts the intermediate transfer belt 11.

With this configuration, a tangent line N at the end of the secondary transfer section can be made more horizontal as compared with a configuration in which the secondary-transfer opposed roller 13 contacts the intermediate transfer belt 11 before the secondary transfer roller 102 contacts the intermediate transfer belt 11.

Thus, even when the recording medium passing the secondary transfer section is less resilient, the recording medium flexes due to gravity and is conveyed while contacting the rib 109 of the secondary transfer roller assembly.

It is to be noted that with respect to a relatively resilient recording medium, since such a recording medium moves substantially straight along the tangent line N at the end of the secondary transfer section, the recording medium is conveyed contacting reliably the rib 109 of the secondary transfer roller assembly 100 which is disposed ahead of the tangent line N.

With this configuration, regardless of types of recording media sheets such as resilience of recording media sheets, the recording medium, a portion of which has passed through the secondary transfer section, can be conveyed contacting the rib 109 reliably. A reliable transport path of the recording medium after passing through the secondary transfer section is obtained.

As a result, the distance between the recording medium that passes through the sheet transport path after the secondary transfer section and each of the static eliminating needles 106*a* of the static eliminating plate 106 disposed between the ribs 109 does not change regardless of the types of recording media sheets, thus eliminating reliably static charges from the recording medium.

The ribs 109 are disposed at the intermediate transfer belt side, thereby preventing toner on the recording medium from getting reversely charged due to the potential of the secondary transfer roller and hence preventing toner from scattering.

As illustrated in FIG. 16, the secondary transfer roller 102 is disposed to engage the intermediate transfer belt 11 with a depth of approximately 2 mm. In other words, the intermediate transfer belt 11 is wound partially around the secondary transfer roller 102.

As described above, the secondary transfer roller 102 contacts the intermediate transfer belt 11 before the secondary-transfer opposed roller 13 contacts the intermediate transfer belt 11, and an area in which only the secondary transfer roller 102 contacts the intermediate transfer belt 11 is formed. With this configuration, undesirable electrical discharge is prevented between the secondary transfer roller 102 and the intermediate transfer belt 11 so as to stabilize the electrical field at the secondary transfer section and prevent scattering of toner.

According to the present illustrative embodiment as described above, the recording medium moves towards the guide plate 101. A transport speed of the portion of recording medium passing through the fixing device is slower than the transport speed of the portion of the recording medium passing through the transfer region. For example, the linear velocity of the fixing roller 20*a* is slower than the linear velocity of the secondary transfer roller 102.

With this configuration, the recording medium retains slack between the secondary transfer section and the fixing device 20, and the recording medium can contact tightly the guide plate 101, thereby reliably eliminating static charges on the recording medium without loosely contacting the guide plate 101. Thus, scattering of toner is prevented. According to the present illustrative embodiment, the intermediate transfer belt 11 is formed of polyimide as a main component to reduce a friction coefficient of the surface of the intermediate transfer belt 11. With this configuration, the recording medium can contact tightly the secondary transfer roller 102, and the transport path of the portion of the recording medium which has passed through the transfer region can be near the static eliminating plate 106.

[Aspect A]

A static eliminator includes a plurality of static eliminating needles such as the static eliminating needles 106*a* with leading ends thereof which are free ends facing a surface of a recording medium and arranged in a width direction of the recording medium; a holder such as the plate holder 108 including a retaining surface such as the retaining surface 108*a* to hold the plurality of static eliminating needles on the retaining surface 108*a*; a plurality of partitions such as the plurality of ribs 109 arranged between the static eliminating needles and disposed in a standing manner; and a restriction member such as the guide plate 101 disposed facing the retaining surface of the holder via the static eliminating needles, the restriction member including a bottom end portion such as the bottom end portion 101*a* and a restriction surface such as the end surface 101*b* to contact the static eliminating needles to regulate a range of movement of the leading end of the static eliminating needles. A length (amount of projection) of the static eliminating needle from an origin which is an end portion of the bottom end portion 101*a* of the restriction member at the static eliminating needle side to the leading end of the static eliminating needle is shorter than the distance from the origin to the end surface of the partition within a range from the retaining surface up to at least a position approximately five degrees (5°) below the restriction surface in an angle between the retaining surface and an imaginary plane including the restriction surface.

In Aspect A, in a case in which clothes of technicians are caught by the static eliminating needle, thus applying an external force to the static eliminating needle and bending the static eliminating needle, the degree of bent of the static eliminating needle is restricted by the restriction surface of the restriction member. When the external force is removed the leading end of the static eliminating needle springs back a little to the retaining surface relative to the place of contact at which the static eliminating needle contacts the end surface of the restriction surface due to resilience of the static eliminating needle. Accordingly, the amount of projection of the leading end of the static eliminating needle from the end portion of the static eliminating needle is less than the distance from the origin to the end surface of the partition within the range of movement. The leading end of the static eliminating needle does not project beyond the end surface of the partitions.

With this configuration, even when the static eliminating needle is bent, the leading end of the static eliminating needle does not project beyond the end surface of the partitions, hence preventing the leading end of the static eliminating needle from contacting the recording medium and keeping the leading end of the static eliminating needle from damage.

[Aspect B]

According to Aspect A, the length of the leading end of the static eliminating needle from the origin is shorter than the distance from the origin to the end surface of the partition within a range from the retaining surface to the restriction surface. With this configuration, as described above, even when the static eliminating needle is bent, the leading end of the static eliminating needle does not project beyond the end surface of the partitions.

[Aspect C]

According to Aspect A or Aspect B, the restriction member is disposed upstream from a pressing member in the transport direction of the recording medium. The pressing member presses the static eliminating needle against the retaining surface. The partition and the restriction member are in contact with each other in the width direction of the recording medium. With this configuration, as described above, a free length of the static eliminating needle can be shorter than that without the restriction member.

[Aspect D]

According to Aspect A or Aspect B, the restriction member is disposed upstream from a pressing member in the transport direction of the recording medium, and the pressing member presses the static eliminating needle against the retaining surface. There is a space between the partition and the restriction member in the width direction of the recording medium. With this configuration, as described above, a free length of the static eliminating needle can be shorter than that without the restriction member. Furthermore, this configuration allows the static eliminating needle to contact air more easily as compared with a configuration in which the restriction member contacts the partition, thereby increasing static elimination efficiency.

[Aspect E]

According to any one of Aspects A through D, an image forming apparatus includes the static eliminator of any one of Aspects A through D that eliminates static charges from the recording medium that has passed through the transfer region at which a toner image formed on an image bearing member such as the intermediate transfer belt 11 is transferred onto a recording medium. With this configuration, as described above, the leading end of the static eliminating needle is prevented from getting damaged, thereby enabling good image formation over time.

[Aspect F]

According to Aspect E, the image bearing member is a belt formed into an endless loop entrained around a plurality of support rollers. The image forming apparatus includes a transfer device such as the secondary transfer roller 102 disposed on the side opposite to and downstream from one of the support rollers such as the secondary-transfer opposed roller 13. The one of the support rollers, around which the image bearing member is entrained, and the transfer device form the transfer region therebetween. With this configuration, as described above, the recording medium can be biased against the static eliminating needle side, thereby transporting the recording medium relative to the leading end of the static eliminating needle with accuracy. Static electricity is eliminated accurately from the recording medium, hence preventing toner from scattering.

[Aspect G]

According to Aspect F, the transfer device is disposed upstream from the one of support rollers in the traveling direction of the belt such that the transfer device contacts the belt before the one of support rollers contacts the belt, thereby forming an area in which the transfer device contacts the belt without contacting the one of support rollers via the belt. With this configuration, as described above, this configuration suppresses abnormal electrical discharge between the transfer device and the belt, hence preventing scattering of toner.

[Aspect H]

According to any one of Aspects E through G, the image forming apparatus includes a fixing mechanism such as the fixing device 20 to fix the toner image transferred onto the recording medium, and a sheet transport speed of the recording medium passing through the transfer region is slower than the sheet transport speed of the recording medium passing through the fixing mechanism. With this configuration, as described above, the distance between the portion of the recording medium that has passed through the transfer region and the static eliminating needle is stabilized, thereby reliably eliminating static charges from the recording medium.

[Aspect I]

According to any one of Aspects E through H, the transfer device such as the secondary transfer roller 102 is disposed opposite to the image bearing member to form the transfer region therebetween, and the transfer device has a barrel shape. With this configuration, as described above, variations in a pressure at the transfer region in the width direction of the recording medium can be reduced.

[Aspect J]

According to any one of Aspects E through me, the image baring member is a belt formed into a loop and entrained around a plurality of support rollers. The image forming apparatus includes a transfer device such as the secondary transfer roller 102 disposed below and opposite to one of support rollers such as the secondary-transfer opposed roller 13. The transfer device is entrained around the one of support rollers to form the transfer region therebetween, and material of metal cored bar of the transfer device is iron. With this configuration, as described above, the transfer device is prevented from getting loose, hence transporting the recording medium while pressing the recording medium at an even pressure over the entire surface.

[Aspect K]

According to any one of Aspects E through J, the image bearing member is a belt formed into an endless loop and entrained around a plurality of support rollers. Material of the belt includes, but is not limited to, polyimide as a main component. With this configuration, as described above, the recording medium can contact the transfer device tightly by reducing a friction coefficient of the surface of the belt. The transport path of the recording medium after passing through the transfer region can be near the static eliminating plate reliably.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A static eliminator, comprising:

a plurality of static eliminating needles arranged in a width direction of a recording medium, including a free end at one end of the plurality of static eliminating needles facing a surface of the recording medium;

a holder including a retaining surface on which the plurality of static eliminating needles is held;

a plurality of partitions arranged in a standing manner between the plurality of static eliminating needles on the retaining surface of the holder;

a restriction member disposed facing the retaining surface of the holder via the plurality of static eliminating needles, the restriction member including a first end portion having a restriction surface at a static eliminating needle side to contact the plurality of static eliminating needles to regulate a range of movement of a leading end of the plurality of static eliminating needles; and a pressing member to press the plurality of static eliminating needles against the retaining surface, wherein a length of the plurality of static eliminating needles from the first end portion as an origin to the leading end of the plurality of static eliminating needles is shorter than a distance from the origin to an end surface of the plurality of partitions within the range of movement of the plurality of static eliminating needles from the retaining surface up to a position five degrees (5°) below the restriction surface in an angle between the retaining surface and an imaginary plane including the restriction surface, and wherein the restriction member is disposed upstream from the pressing member in a transport direction of the recording medium and contacts the plurality of partitions in the width direction of the recording medium.

2. The static eliminator according to claim 1, wherein the length of the plurality of static eliminating needles from the origin to the leading end of the plurality of static eliminating needles is shorter than a distance from the origin to the end surface of the plurality of partitions within the range of movement of the plurality of static eliminating needles from the retaining surface up to the restriction surface.

3. A static eliminator, comprising:

a plurality of static eliminating needles arranged in a width direction of a recording medium, including a free end at one end of the plurality of static eliminating needles facing a surface of the recording medium;

a holder including a retaining surface on which the plurality of static eliminating needles is held;

a plurality of partitions arranged in a standing manner between the plurality of static eliminating needles on the retaining surface of the holder;

a restriction member disposed facing the retaining surface of the holder via the plurality of static eliminating needles, the restriction member including a first end portion having a restriction surface at a static eliminating needle side to contact the plurality of static eliminating needles to regulate a range of movement of a leading end of the plurality of static eliminating needles; and a pressing member to press the plurality of static eliminating needles against the retaining surface, wherein a length of the plurality of static eliminating needles from the first end portion as an origin to the leading end of the plurality of static eliminating needles is shorter than a distance from the origin to an end surface of the plurality of partitions within the range of movement of the plurality of static eliminating needles from the retaining surface up to a position five degrees (5°) below the restriction surface in an angle between the retaining surface and an imaginary plane including the restriction surface, and wherein the restriction member is disposed upstream from the pressing member in a transport direction of the recording medium, and the plurality of partitions and the restriction member are spaced apart in the width direction of the recording medium.

4. The static eliminator according to claim 3, wherein the length of the plurality of static eliminating needles from the origin to the leading end of the plurality of static eliminating needles is shorter than a distance from the origin to the end surface of the plurality of partitions within the range of movement of the plurality of static eliminating needles from the retaining surface up to the restriction surface.

5. An image forming apparatus, comprising:

an image bearing member to bear a toner image on a surface thereof;

a transfer device to transfer the toner image from the image bearing member onto a recording medium at a transfer region;

a static eliminator to eliminate static charges from the recording medium that has passed through the transfer region; and a fixing device to fix the toner image transferred on the recording medium, wherein a transport speed of the recording medium passing through the transfer region is slower than a transport speed of the recording medium passing through the fixing device, wherein the static eliminator includes a plurality of static eliminating needles arranged in a width direction of a recording medium, including a free end at one end of the plurality of static eliminating needles facing a surface of the recording medium, a holder including a retaining surface on which the plurality of static eliminating needles is held, a plurality of partitions arranged in a standing manner between the plurality of static eliminating needles on the retaining surface of the holder, and a restriction member disposed facing the retaining surface of the holder via the plurality of static eliminating needles, the restriction member including a first end portion having a restriction surface at a static eliminating needle side to contact the plurality of static eliminating needles to regulate a range of movement of a leading end of the plurality of static eliminating needles, and wherein a length of the plurality of static eliminating needles from the first end portion as an origin to the leading end of the plurality of static eliminating needles is shorter than a distance from the origin to an end surface of the plurality of partitions within the range of movement of the plurality of static eliminating needles from the retaining surface up to a position five degrees (5°) below the restriction surface in an angle between the retaining surface and an imaginary plane including the restriction surface.

6. The image forming apparatus according to claim 5, wherein the image bearing member is a belt formed into an endless loop entrained about a plurality of support rollers, and the transfer device is disposed below and opposite to one of the plurality of support rollers to form the transfer region between the transfer device and a wound portion of the image bearing member.

7. The image forming apparatus according to claim 6, wherein the transfer device is disposed upstream from the one of the support rollers in a traveling direction of the image bearing member to contact the image bearing member before the one of the plurality of support rollers contacts the image bearing member and to form an area in which the transfer device contacts the image bearing member without contacting the one of the plurality of support rollers via the image bearing member.

8. The image forming apparatus according to claim 5, wherein the transfer device is disposed opposite to the image bearing member to form the transfer region therebetween, and the transfer device includes a barrel shaped roller.

9. The image forming apparatus according to claim 5, wherein the transfer device is a roller including a metal cored bar formed of iron.

10. The image forming apparatus according to claim 5, wherein a material of the image bearing member includes polyimide as a main component.

11. The image forming apparatus according to claim 5, wherein the length of the plurality of static eliminating needles from the origin to the leading end of the plurality of static eliminating needles is shorter than a distance from the origin to the end surface of the plurality of partitions within the range of movement of the plurality of static eliminating needles from the retaining surface up to the restriction surface.

12. An image forming apparatus, comprising:

a static eliminating needle with a leading end thereof facing a transport path along which a recording medium is transported;

a first holder to hold the static eliminating needle such that the leading end of the static eliminating needle projects beyond the first holder for a predetermined distance;

a pair of ribs disposed near the static eliminating needle such that the leading end of the static eliminating needle does not project beyond the pair of ribs within a range of movement from a position at which the leading end of the static eliminating needle faces the transport path to a position of the leading end of the static eliminating needle bent vertically from the first holder as an origin; and a pressing member to press the static eliminating needle against a retaining surface, wherein the first holder is disposed upstream from the pressing member in a transport direction of the recording medium.

13. The image forming apparatus according to claim 12, further comprising a second holder to hold the static eliminating needle at a position opposite to the first holder.

14. An image forming apparatus, comprising:

a static eliminating needle with a leading end thereof facing a transport path along which a recording medium is transported;

a pair of ribs disposed near the leading end of the static eliminating needle;

a projection disposed between the pair of ribs; and a pressing member to press the static eliminating needle against a retaining surface, a first holder to hold the static eliminating needle being disposed upstream from the pressing member in a transport direction of the recording medium, wherein the leading end of the static eliminating needle projects beyond the projection for a predetermined distance toward the transport path, and the pair of ribs is disposed such that the leading end of the static eliminating needle does not project beyond the pair of ribs within a range from a position at which the leading end of the static eliminating needle faces the transport path to a position of the leading end of the static eliminating needle bent vertically from the pair of ribs as an origin.

15. The image forming apparatus according to claim 14, further comprising a second holder to hold the static eliminating needle at a position opposite to the projection.

* * * * *